US012441566B2

(12) United States Patent
Shimosaka et al.

(10) Patent No.: US 12,441,566 B2
(45) Date of Patent: Oct. 14, 2025

(54) MEDIUM CONVEYANCE APPARATUS TO DETERMINE WHETHER TILT ANGLE OF MEDIUM HAS CHANGED BASED ON TIME FROM WHEN ANY SENSOR DETECTS MEDIUM TO WHEN ANOTHER SENSOR DETECTS MEDIUM

(71) Applicant: PFU LIMITED, Kahoku (JP)

(72) Inventors: Kiichiro Shimosaka, Kahoku (JP); Syuichi Morikawa, Kahoku (JP)

(73) Assignee: PFU LIMITED, Kahoku (JP)

( * ) Notice: Subject to any disclaimer, the term of this patent is extended or adjusted under 35 U.S.C. 154(b) by 205 days.

(21) Appl. No.: 18/470,845

(22) Filed: Sep. 20, 2023

(65) Prior Publication Data

US 2024/0132314 A1 Apr. 25, 2024
US 2024/0228208 A9 Jul. 11, 2024

(30) Foreign Application Priority Data

Oct. 19, 2022 (JP) ..... 2022-167896

(51) Int. Cl.
*B65H 7/06* (2006.01)
*B65H 7/14* (2006.01)
*B65H 9/00* (2006.01)

(52) U.S. Cl.
CPC ..... *B65H 7/06* (2013.01); *B65H 7/14* (2013.01); *B65H 9/002* (2013.01); *B65H 2511/24* (2013.01)

(58) Field of Classification Search
CPC ..... B65H 7/06; B65H 7/14; G07D 11/22
See application file for complete search history.

(56) References Cited

U.S. PATENT DOCUMENTS 11,767,188 B2 * 9/2023 Shimada ..... B65H 9/002 271/227
12,234,119 B2 * 2/2025 Yoshita ..... B65H 7/20
12,264,035 B2 * 4/2025 Matsumura ..... B65H 3/0607
2018/0220022 A1 8/2018 Yoshikaie et al.
2019/0037092 A1 1/2019 Shiota
(Continued)

FOREIGN PATENT DOCUMENTS

JP 2019-29816 A 2/2019
JP 2020-152542 A 9/2020
(Continued)

*Primary Examiner* — Patrick Cicchino
(74) *Attorney, Agent, or Firm* — WOMBLE BOND DICKINSON (US) LLP

(57) ABSTRACT

A medium conveyance apparatus includes a first sensor located at a center part in a direction perpendicular to a medium conveyance direction; a second sensor located at a downstream side from the first sensor in the medium conveyance direction and at the center part in the direction perpendicular to the medium conveyance direction, a third sensor located at a downstream side from the second sensor in the medium conveyance direction and at the one side in the direction perpendicular to the medium conveyance direction, and a processor to determine whether a tilt angle of the medium being conveyed has changed based on a time from when the first sensor detects the medium to when the second sensor detects the medium when the first sensor detects the medium first, the third sensor detects the medium second, and the second sensor detects the medium third.

9 Claims, 18 Drawing Sheets

(56) References Cited

U.S. PATENT DOCUMENTS

| | | | | |
|---|---|---|---|---|
| 2020/0299091 | A1 | 9/2020 | Umi et al. | |
| 2024/0092604 | A1 * | 3/2024 | Shimosaka | B65H 3/063 |
| 2024/0343522 | A1 * | 10/2024 | Morikawa | B65H 43/04 |

FOREIGN PATENT DOCUMENTS

| | | | |
|---|---|---|---|
| JP | 6922233 | B2 | 8/2021 |
| WO | WO-2022153497 | A1 * | 7/2022 |

* cited by examiner

FIG. 5

| NO. | ORDER | | | | | TIME | | ... |
|---|---|---|---|---|---|---|---|---|
| | FIRST | SECOND | THIRD | FOURTH | FIFTH | COVERAGE | CRITERIA | ... |
| 1 | FIRST CENTER SENSOR | FIRST SIDE SENSOR | SECOND CENTER SENSOR | — | — | FIRST TO THIRD | LARGER THAN T1 | ... |
| 2 | FIRST CENTER SENSOR | FIRST SIDE SENSOR | SECOND CENTER SENSOR | SECOND SIDE SENSOR (SAME SIDE) | — | FIRST TO FOURTH | LARGER THAN T2 | ... |
| 3 | FIRST CENTER SENSOR | FIRST SIDE SENSOR | SECOND CENTER SENSOR | SECOND SIDE SENSOR (SAME SIDE) | FIRST SIDE SENSOR (OPPOSITE SIDE) | FIRST TO FIFTH | LARGER THAN T3 | ... |
| 4 | FIRST CENTER SENSOR | FIRST SIDE SENSOR | SECOND CENTER SENSOR | FIRST SIDE SENSOR (OPPOSITE SIDE) | — | FIRST TO FOURTH | LARGER THAN T4 | ... |
| 5 | FIRST CENTER SENSOR | FIRST SIDE SENSOR | SECOND SIDE SENSOR (SAME SIDE) | — | — | FIRST TO THIRD | LARGER THAN T5 | ... |
| 6 | FIRST CENTER SENSOR | FIRST SIDE SENSOR | SECOND SIDE SENSOR (SAME SIDE) | SECOND CENTER SENSOR | — | FIRST TO FOURTH | LARGER THAN T6 | ... |
| 7 | FIRST CENTER SENSOR | FIRST SIDE SENSOR | SECOND SIDE SENSOR (SAME SIDE) | SECOND CENTER SENSOR | FIRST SIDE SENSOR (OPPOSITE SIDE) | FIRST TO FIFTH | LARGER THAN T7 | ... |
| ... | ... | ... | ... | ... | ... | ... | ... | ... |

FIG. 7

| NO. | ORDER | | | | | TIME | | ... |
|---|---|---|---|---|---|---|---|---|
| | FIRST | SECOND | THIRD | FOURTH | FIFTH | COVERAGE | CRITERIA | ... |
| 1 | FIRST SIDE SENSOR | FIRST CENTER SENSOR | — | — | — | — | ANY | ... |
| 2 | FIRST SIDE SENSOR | SECOND CENTER SENSOR | — | — | — | — | ANY | ... |
| 3 | FIRST SIDE SENSOR | SECOND SIDE SENSOR (SAME SIDE) | FIRST CENTER SENSOR | — | — | — | ANY | ... |
| 4 | FIRST SIDE SENSOR | SECOND SIDE SENSOR (SAME SIDE) | SECOND CENTER SENSOR | — | — | — | ANY | ... |
| ... | ... | ... | ... | ... | ... | ... | ... | ... |

FIG. 13A

| NO. | ORDER | | | | | TIME | | ... |
|---|---|---|---|---|---|---|---|---|
| | FIRST | SECOND | THIRD | FOURTH | FIFTH | COVERAGE | CRITERIA | ... |
| 8 | FIRST SIDE SENSOR | FIRST CENTER SENSOR | SECOND SIDE SENSOR (SAME SIDE) | SECOND CENTER SENSOR | — | FIRST TO FOURTH | LARGER THAN T8 | ... |
| 9 | FIRST SIDE SENSOR | SECOND SIDE SENSOR (SAME SIDE) | FIRST CENTER SENSOR | SECOND CENTER SENSOR | — | FIRST TO FOURTH | LARGER THAN T9 | ... |
| ... | ... | ... | ... | ... | ... | ... | ... | ... |

FIG. 13B

| NO. | ORDER | | | | | TIME | | ... |
|---|---|---|---|---|---|---|---|---|
| | FIRST | SECOND | THIRD | FOURTH | FIFTH | COVERAGE | CRITERIA | ... |
| 1 | FIRST SIDE SENSOR | FIRST CENTER SENSOR | SECOND SIDE SENSOR (SAME SIDE) | SECOND CENTER SENSOR | — | FIRST TO FOURTH | T8 or less | ... |
| 2 | FIRST SIDE SENSOR | SECOND SIDE SENSOR (SAME SIDE) | FIRST CENTER SENSOR | SECOND CENTER SENSOR | — | FIRST TO FOURTH | T9 or less | ... |
| ... | ... | ... | ... | ... | ... | ... | ... | ... |

FIG. 16A

| NO. | ORDER | | | | | TIME | | ... |
|---|---|---|---|---|---|---|---|---|
| | FIRST | SECOND | THIRD | FOURTH | FIFTH | COVERAGE | CRITERIA | ... |
| 1 | FIRST CENTER SENSOR | FIRST SIDE SENSOR | SECOND SIDE SENSOR (SAME SIDE) | — | — | FIRST TO THIRD | LARGER THAN T10 | ... |
| 2 | FIRST CENTER SENSOR | FIRST SIDE SENSOR | SECOND SIDE SENSOR (SAME SIDE) | FIRST SIDE SENSOR (OPPOSITE SIDE) | — | FIRST TO FOURTH | LARGER THAN T11 | ... |
| 3 | FIRST SIDE SENSOR | FIRST CENTER SENSOR | SECOND SIDE SENSOR (SAME SIDE) | — | — | FIRST TO THIRD | LARGER THAN T12 | ... |
| 4 | FIRST SIDE SENSOR | FIRST CENTER SENSOR | SECOND SIDE SENSOR (SAME SIDE) | FIRST SIDE SENSOR (OPPOSITE SIDE) | — | FIRST TO FOURTH | LARGER THAN T13 | ... |
| ... | ... | ... | ... | ... | ... | ... | ... | ... |

FIG. 16B

| NO. | ORDER | | | | | TIME | | ... |
|---|---|---|---|---|---|---|---|---|
| | FIRST | SECOND | THIRD | FOURTH | FIFTH | COVERAGE | CRITERIA | ... |
| 1 | FIRST SIDE SENSOR | FIRST CENTER SENSOR | — | — | — | — | ANY | ... |
| 2 | FIRST SIDE SENSOR | SECOND SIDE SENSOR (SAME SIDE) | FIRST CENTER SENSOR | — | — | — | ANY | ... |
| ... | ... | ... | ... | ... | ... | ... | ... | ... |

FIG. 17A

| NO. | ORDER | | | | | TIME | | ... |
|---|---|---|---|---|---|---|---|---|
| | FIRST | SECOND | THIRD | FOURTH | FIFTH | COVERAGE | CRITERIA | ... |
| 5 | FIRST SIDE SENSOR | SECOND SIDE SENSOR (SAME SIDE) | FIRST CENTER SENSOR | — | — | FIRST TO THIRD | LARGER THAN T14 | ... |
| ... | ... | ... | ... | ... | ... | ... | ... | ... |

FIG. 17B

| NO. | ORDER | | | | | TIME | | ... |
|---|---|---|---|---|---|---|---|---|
| | FIRST | SECOND | THIRD | FOURTH | FIFTH | COVERAGE | CRITERIA | ... |
| 1 | FIRST SIDE SENSOR | SECOND SIDE SENSOR (SAME SIDE) | FIRST CENTER SENSOR | — | — | FIRST TO THIRD | T14 or less | ... |
| ... | ... | ... | ... | ... | ... | ... | ... | ... |

MEDIUM CONVEYANCE APPARATUS TO DETERMINE WHETHER TILT ANGLE OF MEDIUM HAS CHANGED BASED ON TIME FROM WHEN ANY SENSOR DETECTS MEDIUM TO WHEN ANOTHER SENSOR DETECTS MEDIUM

CROSS-REFERENCE TO RELATED APPLICATIONS

This application is based upon and claims the benefit of priority of prior Japanese Patent Application No. 2022-167896, filed on Oct. 19, 2022, the entire contents of which are incorporated herein by reference.

TECHNICAL FIELD

Embodiments discussed in the present specification relate to conveyance of a medium.

BACKGROUND

In a scanner or other medium conveyance apparatus which conveys a medium while capturing an image of it, a tilt angle of the medium being conveyed may change and entire medium may not be captured or the medium may strike a side wall of a conveyance path and jamming of the medium (paper jam) may occur.

An image reading apparatus provided with a first detection part, a second detection part, and a third detection part, to stop conveyance of a medium based on the results of detection of the first detection part, second detection part, and third detection part is known. The first detection part is provided so as to be positioned between a first position being a nip position of a feed roller and a separation roller and a second position being a nip position of a pair of conveyance rollers in a medium conveyance direction, and at the both sides of the feed roller and pair of conveyance rollers in a medium width direction. The second detection part is provided so as to be positioned between the first detection part and the second position in the medium conveyance direction, and at the both sides of the feed roller and the pair of conveyance rollers in the medium width direction. The third detection part is located between a pair of second detection parts in the medium width direction, and at a downstream side from the first position and an upstream side from the pair of second detection parts in the medium conveyance direction.

SUMMARY

According to some embodiments, a medium conveyance apparatus includes a conveyance roller to convey a medium, a first sensor located at a center part of a medium conveyance path in a direction perpendicular to a medium conveyance direction, a second sensor located at a downstream side from the first sensor in the medium conveyance direction and at the center part of the medium conveyance path in the direction perpendicular to the medium conveyance direction, a third sensor located at a downstream side from the second sensor in the medium conveyance direction and at the one side of the medium conveyance path in the direction perpendicular to the medium conveyance direction, and a processor to determine whether a tilt angle of the medium being conveyed has changed based on a time from when the first sensor detects the medium to when the second sensor detects the medium when the first sensor detects the medium first, the third sensor detects the medium second, and the second sensor detects the medium third.

According to some embodiments, a medium conveyance apparatus includes a conveyance roller to convey a medium, a first sensor located at a center part of a medium conveyance path in a direction perpendicular to a medium conveyance direction, a second sensor located at a downstream side from the first sensor in the medium conveyance direction and the one side of the medium conveyance path in the direction perpendicular to the medium conveyance direction, a third sensor located at a downstream side from the second sensor in the medium conveyance direction at the one side of the medium conveyance path in the direction perpendicular to the medium conveyance direction, and a processor to determine whether a tilt angle of the medium being conveyed has changed based on a time from when one of the first sensor and the second sensor detects the medium to when the third sensor detects the medium when the one of the first sensor and the second sensor detects the medium first, the other of the first sensor and second sensor detects the medium second, and the third sensor detects the medium third.

According to some embodiments, a medium conveyance apparatus includes a conveyance roller to convey a medium, a center sensor located at a center part of a medium conveyance path in a direction perpendicular to a medium conveyance direction, a side sensor located at a downstream side from the center sensor in the medium conveyance direction and one side of the medium conveyance path in a direction perpendicular to the medium conveyance direction, and a processor to determine whether a tilt angle of the medium being conveyed has changed. At least one of the center sensor and the side sensor includes two sensors located at positions different from each other in the medium conveyance direction. The processor determines whether the tilt angle of the medium being conveyed has changed based on which one of sensors detected the medium first, second, and third, and a time from when the sensor detected the medium first detected the medium to when the sensor detected the medium third detected the medium.

BRIEF DESCRIPTION OF DRAWINGS

FIG. 5 is a view presenting one example of a data structure of a cumulative skew condition table.

FIG. 7 is a view presenting one example of a data structure of an abnormal skew condition table.

FIG. 13A is a view presenting one example of a data structure of another cumulative skew condition table.

FIG. 13B is a view presenting one example of a data structure of another abnormal skew condition table.

FIG. 16A is a view presenting one example of a data structure of another cumulative skew condition table.

FIG. 16B is a view presenting one example of a data structure of another abnormal skew condition table.

FIG. 17A is a view presenting one example of a data structure of another cumulative skew condition table.

FIG. 17B is a view presenting one example of a data structure of another abnormal skew condition table.

DESCRIPTION OF EMBODIMENTS

It is to be understood that both the foregoing general description and the following detailed description are exemplary and explanatory, and are not restrictive of the invention, as claimed.

Hereinafter, a medium conveyance apparatus, medium conveyance method and computer-readable, non-transitory medium according to an embodiment, will be described with reference to the drawings. However, it should be noted that the technical scope of the invention is not limited to these embodiments, and extends to the inventions described in the claims and their equivalents.

Figure 1:
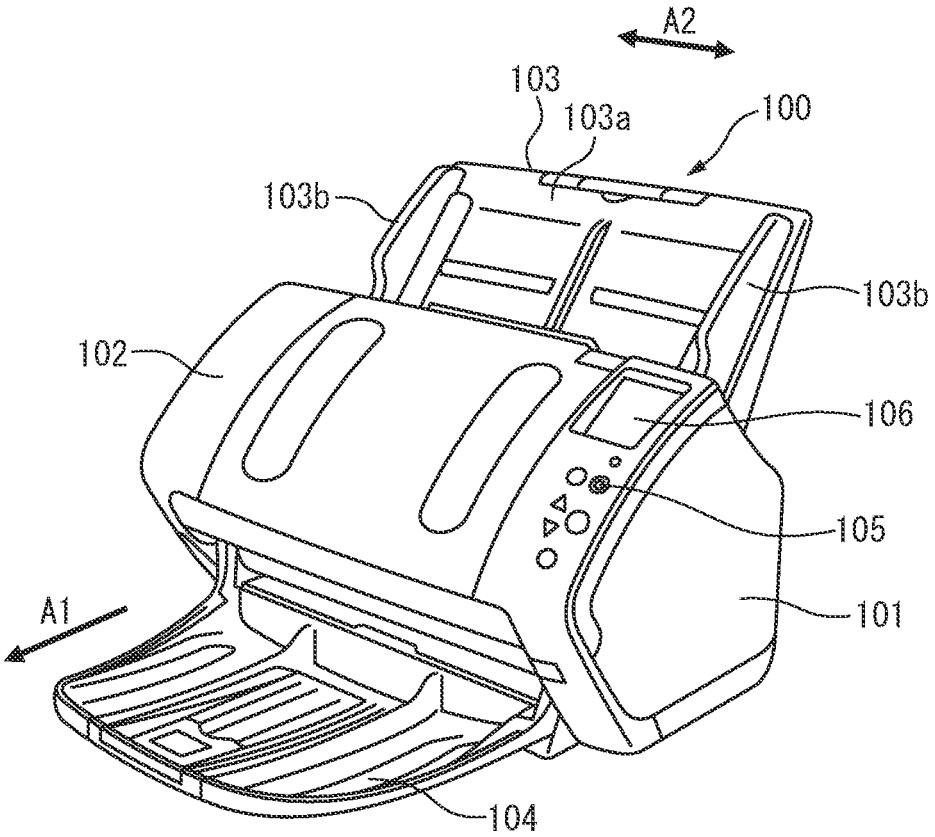
FIG. 1 is a perspective view illustrating a medium conveyance apparatus according to an embodiment.

FIG. 1 is a perspective view illustrating an example of a medium conveyance apparatus constituted as an image scanner. The medium conveyance apparatus 100 conveys a document as a medium and captures an image of it. The medium is regular paper, thick paper, cards, booklets, passports, etc. The medium feed apparatus 100 may be a facsimile, copier, multifunction peripheral (MFP), etc. The medium being conveyed may be a printed object, etc., rather than a document and the medium conveyance apparatus 100 may be a printer, etc.

In FIG. 1, an arrow A1 indicates a medium conveyance direction while an arrow A2 indicates a width direction perpendicular to the medium conveyance direction. Below, "upstream" means upstream in the medium conveyance direction A1, while "downstream" means downstream in the medium conveyance direction A1.

The medium conveyance apparatus 100 is provided with a lower housing 101, upper housing 102, stacking tray 103, ejection tray 104, operating device 105, display device 106, etc.

The upper housing 102 is located at a position covering the top surface of the medium conveyance apparatus 100 and is engaged with the lower housing 101 by hinges to enable it to be opened and closed at the time of jamming of the medium or the time of cleaning the inside of the medium conveyance apparatus 100, etc.

The stacking tray 103 is engaged with the lower housing 101. The stacking tray 103 has a stacking surface 103*a* for stacking the medium and stacks the medium to be fed and conveyed. On the stacking surface 103*a*, side guides 103*b* are provided to be able to in the width direction A2 perpendicular to the medium conveyance direction. The side guides 103*b* are positioned to match the width of the medium stacked on the stacking tray 103, and limit the width direction of the medium. In the example illustrated in FIG. 1, two side guides 103*b* are located spaced apart so that the medium is located at the center in the width direction A2. Just a single side guide 103*b* may be located at one end part in the width direction A2 such that the medium is placed along with one end part.

The ejection tray 104 is engaged with the upper housing 102 and stacks the ejected medium. The ejection tray 104 may be engaged with the lower housing 101.

The operating device 105 has buttons or other input devices and an interface circuit acquiring signals from the input devices, receiving input operations of a user, and outputting operating signals corresponding to the input operations of a user. The display device 106 has a display including liquid crystals, organic Electro-Luminescence (El), etc., and an interface circuit outputting image data to the display and displaying the image data on the display.

Figure 2:
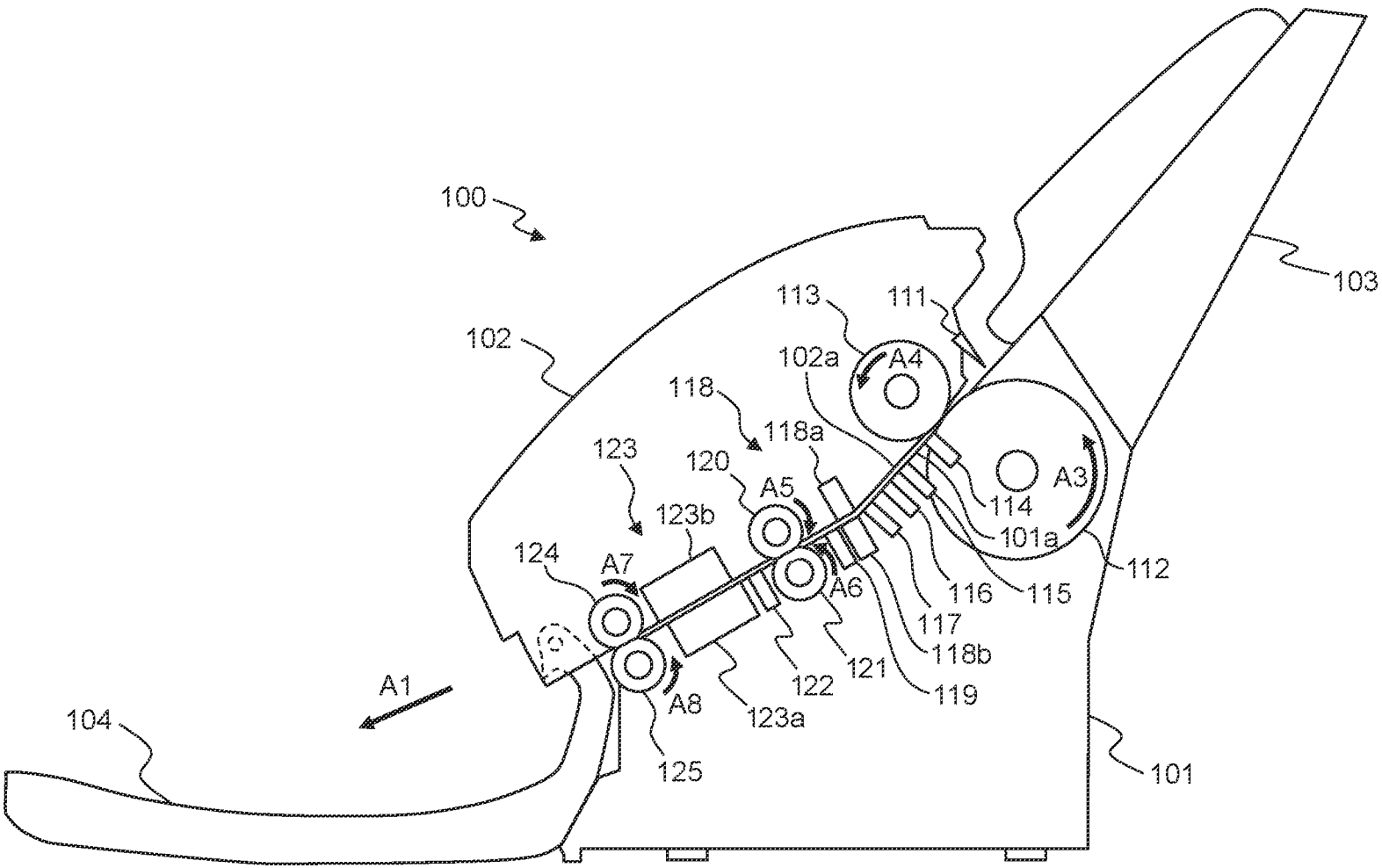
FIG. 2 is a view for explaining a conveyance route inside of a medium conveyance apparatus according to an embodiment.

FIG. 2 is a view for explaining a conveyance route inside of the medium conveyance apparatus according to an embodiment.

The conveyance route inside of the medium conveyance apparatus 100 has a stacking sensor 111, feed roller 112, separation roller 113, first center sensor 114, out-of-region sensor 115, second center sensor 116, first side sensor 117, thickness sensor 118, second side sensor 119, first conveyance roller 120, second conveyance roller 121, third side sensor 122, imaging device 123, third conveyance roller 124, fourth conveyance roller 125, etc.

The feed roller 112, separation roller 113, first conveyance roller 120, second conveyance roller 121, third conveyance roller 124, and/or fourth conveyance roller 125 are examples of the conveyance roller to convey the medium. The numbers of the feed roller 112, separation roller 113, first conveyance roller 120, second conveyance roller 121, third conveyance roller 124, and/or fourth conveyance roller 125 are not limited to one and may be plural. In this case, the plurality of the feed rollers 112, separation rollers 113, first conveyance rollers 120, second conveyance rollers 121, third conveyance rollers 124, and/or fourth conveyance rollers 125 are respectively located spaced apart in the width direction A2.

The medium conveyance apparatus 100 has a so-called "straight path". The top surface of the lower housing 101 forms a lower guide 101*a* of the conveyance path of the medium while the bottom surface of the upper housing 102 forms an upper guide 102*a* of the conveyance path of the medium.

The stacking sensor 111 is located at an upstream side from the feed roller 112 and the separation roller 113. The stacking sensor 111 has a contact detection sensor and detects whether the medium is stacked on the stacking tray 103. The stacking sensor 111 generates and outputs a stacking signal with a signal value changing between a state where the stacking tray 103 has the medium and a state where the stacking tray 103 does not have the medium. The stacking sensor 111 is not limited to a contact detection sensor. A photo detection sensor or any other sensors that can detect the presence of the medium may be used as the stacking sensor 111.

The feed roller 112 is provided at the lower housing 101 and separates and feeds the medium stacked on the stacking tray 103 in order from the lower side. When a plurality of the feed rollers 112 are provided, each of them are provided to rotate independently by separate motors. Each of feed rollers 112 may be provided to rotate together by a common motor. The separation roller 113 is a so-called "brake roller" or "retard roller", is provided at the upper housing 102, is located facing the feed roller 112, and rotates in the opposite direction to the medium feed direction. The separation roller 113 is provided to be able to rotate in the opposite direction A4 of the medium feed direction or stop.

The thickness sensor 118 is located at the downstream side from the feed roller 112 and the separation roller 113 and at the upstream side from the first conveyance roller 120 and the second conveyance roller 121. In the example illustrated in FIG. 2, the thickness sensor 118 is located at the downstream side from the first side sensor 117 and the upstream side from the second side sensor 119. The thickness sensor 118 may be located at any position on the medium conveyance path. The thickness sensor 118 is an ultrasonic sensor and includes an ultrasonic emitter 118*a* and an ultrasonic receiver 118*b*. The ultrasonic emitter 118*a* and the ultrasonic receiver 118*b* are located in the vicinity of the conveyance path of the medium so as to face each other with the conveyance path in between. The ultrasonic emitter 118*a* emits an ultrasonic wave. On the other hand, the ultrasonic receiver 118*b* receives an ultrasonic wave emitted from the ultrasonic emitter 118*a* and passing through the medium and generates and outputs an electrical signal corresponding to the ultrasonic wave received as a thickness signal. The ultrasonic wave passing through the medium is attenuated by the medium as well. The thicker the medium where the ultrasonic wave passes through, the greater the amount of attenuation. Therefore, the medium conveyance apparatus 100 can detect the thickness of the conveyed medium based on the thickness signal. Further, when a plurality of the media are conveyed in an overlapping manner, the ultrasonic wave passing through the medium is attenuated by the air layers between the plurality of the media conveyed in an overlapping manner. Therefore, the medium conveyance apparatus 100 can detect multi-feed of the medium based on the thickness signal.

A reflective light sensor including a pair of a light emitter and light receiver provided at the one side of the medium conveyance path and a pair of a light emitter and light receiver provided at the other side, for example, may be used as the thickness sensor 118. The reflective light sensor detects the distances between each of pairs and the surface of the medium from the time from when a one pair emits light to one surface of the medium to when the one receives the reflected light and the time from when the other pair emits light to the other surface of the medium to when the other receives the reflected light. The reflective light sensor generates a thickness signal indicating a subtracted value of the distance between the two pairs minus the detected distances as the thickness. A pressure sensor which detects a pressing force applied by the conveyed medium to generate and output a thickness signal indicating the detected pressing force as the thickness may be used as the thickness sensor 118. Further, a movement sensor which detects the amount of movement of a contact piece contacting the conveyed medium to generate and output a thickness signal indicating the detected amount of movement as the thickness may be used as the thickness sensor 118.

The first conveyance roller 120 and second conveyance roller 121 are located to face each other at the downstream side from the feed roller 112 and convey the medium fed by the feed roller 112 and the separation roller 113 to the imaging device 123. The first conveyance roller 120 is provided at the upper housing 102, while the second conveyance roller 121 is provided under the first conveyance roller 120 at the lower housing 101. Each of the first conveyance rollers 120 and/or the second conveyance rollers 121 are provided to rotate integrally by a common motor. The first conveyance rollers 120 and/or the second conveyance rollers 121 may be provided to rotate independently by separate motors. Either one of the first conveyance roller 120 and the second conveyance roller 121 may be a driven roller rotated by the other roller.

The imaging device 123 is located at the downstream side of the first conveyance roller 120 and the second conveyance roller 121 and captures an image of the medium conveyed by the first conveyance roller 120 and the second conveyance roller 121. The imaging device 123 includes a first imaging device 123*a* and second imaging device 123*b* located facing each other with the medium conveyance path therebetween. The first imaging device 123*a* includes a line sensor based on a unity-magnification optical system type Contact Image Sensor (CIS) including an imaging element based on a Complementary Metal Oxide Semiconductor (CMOS) linearly located in a main scanning direction. Further, the first imaging device 123*a* includes a lens for forming an image on the imaging element, and an Analog-to-Digital (A/D) converter for amplifying and analog-digital converting an electric signal output from the imaging element. The first imaging device 123*a* captures an image of the front surface of the conveyed medium and generates and outputs an input image in accordance with control from a later explained processing circuit.

Similarly, the second imaging device 123*b* includes a line sensor based on a unity-magnification optical system type CIS including an imaging element based on a CMOS linearly located in a main scanning direction. The second imaging device 123*b* includes a lens for forming an image on the imaging element, and an A/D converter for amplifying and analog-digital converting an electric signal output from the imaging element. The second imaging device 123*b* captures an image of the back surface of the conveyed medium and generates and outputs an input image in accordance with control from a later explained processing circuit.

Note that, the medium feed apparatus 100 may have only one of the first imaging device 125*a* and the second imaging device 125*b* and read only one surface of the medium. Further, a line sensor based on a unity-magnification optical system type CIS including an imaging element based on Charge Coupled Devices (CCDs) may be used in place of the line sensor based on a unity-magnification optical system type CIS including an imaging element based on a CMOS. Further, a line sensor based on a reduction optical system type line sensor including an imaging element based on CMOS or CCDs may be used.

The third conveyance roller 124 and fourth conveyance roller 125 are located so as to face each other at the downstream side from the imaging device 123 and eject the medium conveyed by the first conveyance roller 120 and the second conveyance roller 121 and captured by the imaging device 123 to the ejection tray 104. The third conveyance roller 124 is provided at the upper housing 102, while the fourth conveyance roller 125 is provided at the lower housing 101 at the lower side of the third conveyance roller 124. When several are provided, the third conveyance rollers 124 and/or the fourth conveyance rollers 125 are provided to rotate integrally by a common motor. The third conveyance rollers 124 and/or the fourth conveyance rollers 125 may be provided to rotate independently by separate motors. Either one roller of the third conveyance roller 124 and the fourth conveyance roller 125 may be a driven roller rotating driven by the other roller.

The medium stacked on the stacking tray 103 is conveyed between the lower guide 101*a* and upper guide 102*a* toward the medium conveyance direction A1 by the feed roller 112 rotating in the direction of the arrow A3 of FIG. 2, i.e., the medium feed direction. The medium conveyance apparatus 100 has, a separation mode for separating the medium while feeding and a nonseparation mode for feeding the medium without separating as feed modes. The feed mode is set by the user using the operating device 105 or an information processing apparatus connected to the medium conveyance apparatus 100 to communicate with it. When the feed mode is set to the separation mode, the separation roller 113 rotates in the direction of the arrow A4, i.e., the opposite direction to the medium feed direction, or stops, at the time of medium conveyance. Therefore, conveyance of the medium other than the separated medium is restricted (multi-feed is prevented). On the other hand, when the feed mode is set to the nonseparation mode, the separation roller 113 rotates in the opposite direction of the arrow A4, i.e., the medium feed direction.

The medium is conveyed between the first and second conveyance rollers 122*a* and 122*b* by being guided by the first guide 101*a* and the second guide 102*a*. The medium is conveyed between the first and second imaging devices 123*a* and 123*b* by the first and second conveyance rollers 122*a* and 122*b* respectively rotating in the directions of the arrows A5 and A6. The medium read by the imaging device 125 is ejected onto the ejection tray 104 by the third and fourth conveyance rollers 122*c* and 122*d* respectively rotating in the directions of the arrows A7 and A8.

Figure 3:
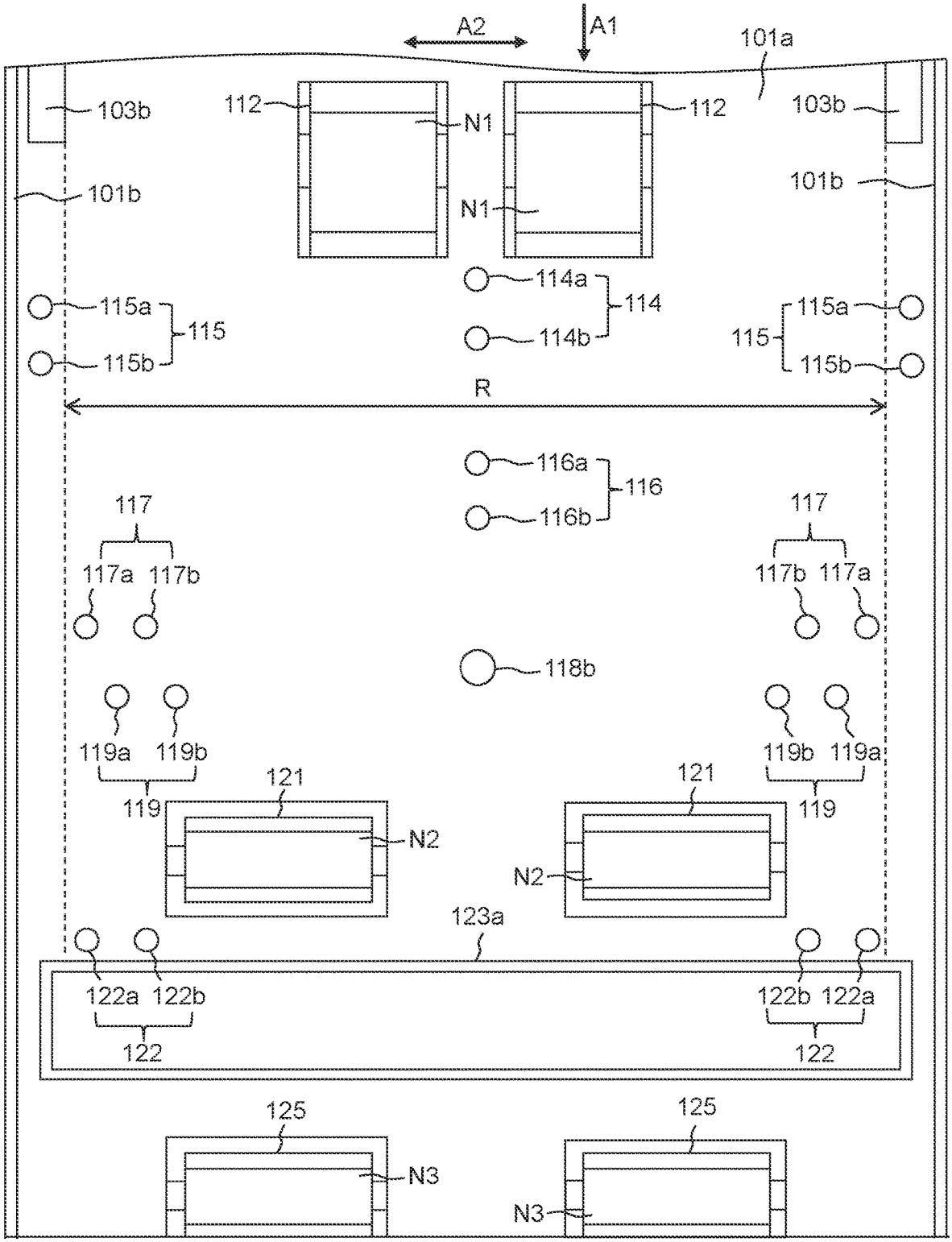
FIG. 3 is a schematic view for explaining sensors.

FIG. 3 is a schematic view for explaining the sensors for detecting the medium according to an embodiment.

In the example illustrated in FIG. 3, each of the feed rollers 112, separation rollers 113, first conveyance rollers 120, second conveyance rollers 121, third conveyance rollers 124, and fourth conveyance rollers 125 are two. Further, there are one of the first center sensor 114 and the second center sensor 116 and two of the out-of-region sensors 115, first side sensors 117, second side sensors 119, and third side sensors 122. There may be any other number of the first center sensor 114, out-of-region sensor 115, second center sensor 116, first side sensor 117, second side sensor 119, and/or third side sensor 122.

The first center sensor 114 is an example of a first sensor and center sensor located at the center part of the medium conveyance path in the direction perpendicular to the medium conveyance direction and detects the medium conveyed to its position of arrangement. The first center sensor 114 is located at the downstream side from the feed rollers 112 and the separation rollers 113 in the medium conveyance direction A1 and at the center part of the medium conveyance path in the width direction A2 perpendicular to the medium conveyance direction. In particular, the first center sensor 114 is located at the downstream side from nip parts N1 of the feed rollers 112 and the separation rollers 113 in the medium conveyance direction A1 and at the upstream side from nip parts N2 of the first conveyance rollers 120 and the second conveyance rollers 121. Further, the first center sensor 114 is located between the plurality of the out-of-region sensors 115, between the plurality of the out-of-region sensors 115, between the plurality of the first side sensors 117, between the second side sensors 119, and/or between the plurality of the third side sensors 122 in the width direction A2. The first center sensor 114 is located between the plurality of the feed rollers 112 (nip parts N1), between the plurality of the first conveyance rollers 120 (nip parts N2), and/or between the plurality of the third conveyance rollers 124 (nip parts N3 of third conveyance rollers 124 and fourth conveyance rollers 125) in the width direction A2. In the example illustrated in FIG. 3, the first center sensor 114 is located in the vicinity of the nip parts N1 of the feed rollers 112 and the separation rollers 113 in the medium conveyance direction A1 and at the center position of the medium conveyance path in the width direction A2.

The first center sensor 114 includes a light emitter 114*a* and light receiver 114*b* provided at one side with respect to the medium conveyance path and a light guide provided at a position facing the light emitter 114*a* and light receiver 114*b* with the medium conveyance path in between. The light emitter 114*a* is an LED (light emitting diode), etc., and emits light toward the medium conveyance path. On the other hand, the light receiver 114*b* is a photodiode, etc., and receives light emitted from the light emitter 114*a* and guided by the light guide. When there is the medium at a position facing at least one of the light emitter 114*a* and light receiver 114*b*, the light emitted from the light emitter 114*a* is blocked by the medium, so the light receiver 114*b* does not detect the light emitted from the light emitter 114*a*. The first center sensor 114 generates and outputs a first center signal with a signal value changing between the state where there is the medium at the position of the first center sensor 114 and the state where there is no medium based on the intensity of the light received by the light receiver 114*b*.

The light emitter 114*a* and light receiver 114*b* are located spaced apart in the medium conveyance direction A1 to be located at the same position in the width direction A2. When the light emitter 114*a* and the light receiver 114*b* are located at different positions in the width direction A2, which position of the light emitter 114*a* and the light receiver 114*b* the medium passes through first will differ depending on the tilt of the medium. On the other hand, when the light emitter 114*a* and light receiver 114*b* are located at the same position in the width direction A2, the possibility that the medium will first pass through one of the light emitter 114*a* and the light receiver 114*b* which is located at the upstream side than the other is high regardless of the tilt. Therefore, the medium conveyance apparatus 100 can accurately identify the timing by which the end part of the medium passes through a specific position in the width direction A2 (position of light emitter 114*a* or position of light receiver 114*b* that is located at upstream side). Further, by the light emitter 114*a* and light receiver 114*b* being located at the same position in the width direction A2, in particular the center position, the error in the timing of detection of the medium due to manufacturing error of the light emitter 114*a*, light receiver 114*b*, and/or position of arrangement of the passage hole of the light is reduced. Therefore, the medium conveyance apparatus 100 can detect the degree of tilt of the medium more accurately by using the first center sensor 114 and the plurality of the first side sensors 117 or the plurality of the second side sensors 119 located at the outside from the first center sensor 114. The light emitter 114*a* and light receiver 114*b* may be located spaced apart in the width direction A2 to be located at different positions in the width direction A2.

The out-of-region sensor 115 detects the medium conveyed to its position of arrangement. In the example illustrated in FIG. 3, two out-of-region sensors 115 are located spaced apart in the width direction A2. The out-of-region sensors 115 are respectively located at the downstream side from the feed rollers 112 and the separation rollers 113, in particular at the downstream side from the first center sensor 114 in the medium conveyance direction A1 and at the both sides of the medium conveyance path in the width direction A2 perpendicular to the medium conveyance direction. In particular, the out-of-region sensors 115 are located at the upstream side from the imaging device 123, in particular at the upstream side from the nip parts N2 of the first conveyance rollers 120 and the second conveyance rollers 121 in the medium conveyance direction A1. Further, the out-of-region sensors 115 are located at the inside (center side) from the side walls 101*b* of the medium conveyance path in the width direction A2. The out-of-region sensors 115 are located at the outside (side wall 101*b* sides) in the width direction A2 from the maximum size medium stacked on the stacking tray 103 that the medium conveyance apparatus 100 supports, i.e., outside from the positions of the inside surfaces of the side guards 103*b* located at the most outer side. Further, the out-of-region sensors 115 are located outside in the width direction A2 from the end positions of the imaging range of the imaging device 123. The out-of-region sensors 115 may be located at the inside in the width direction A2 from the end positions of the imaging range of the imaging device 123.

The out-of-region sensor 115 includes a light emitter 115*a* and light receiver 115*b* provided at one side with respect to the medium conveyance path and a light guide provided at a position facing the light emitter 115*a* and light receiver 115*b* with the medium conveyance path in between. The light emitter 115*a* is an LED, etc., and emits light toward the medium conveyance path. On the other hand, the light receiver 115*b* is a photodiode, etc., and receives light emitted by the light emitter 115*a* and guided by the light guide. When there is the medium at a position facing at least one of the light emitter 115*a* and light receiver 115*b*, the light emitted from the light emitter 115*a* is blocked by the medium, so the light receiver 115*b* does not detect the light emitted from the light emitter 115*a*. The out-of-region sensor 115 generates and outputs an out-of-region signal with a signal value changing between the state where there is the medium at the position of the out-of-region sensor 115 and the state where there is no medium based on the intensity of the light which the light receiver 115*b* receives.

The light emitter 115*a* and light receiver 115*b* are located spaced apart in the medium conveyance direction A1 to be located at the same position in the width direction A2. The light emitter 115*a* and light receiver 115*b* may be located spaced apart in the width direction A2 to be located at different positions in the width direction A2.

The second center sensor 116 is one example of the second sensor and center sensor located at the downstream side from the first sensor in the medium conveyance direction and at the center part of the medium conveyance path in the direction perpendicular to the medium conveyance direction and detects the medium conveyed to its position of arrangement. The second center sensor 116 is located at the downstream side from the feed rollers 112 and the separation rollers 113, in particular, at the downstream side from the first center sensor 114 in the medium conveyance direction A1 and at the center part of the medium conveyance path in the width direction A2 perpendicular to the medium conveyance direction. In other words, the second center sensor 116 is located at a position different from the first center sensor 114 in the medium conveyance direction A1. In particular, the second center sensor 116 is located at the downstream side from the out-of-region sensors 115 and at the upstream side from the imaging device 123, in particular, the upstream side from the nip parts N2 of the first conveyance rollers 120 and the second conveyance rollers 121 in the medium conveyance direction A1. Further, the second center sensor 116 is located between the plurality of the out-of-region sensors 115, between the plurality of the first side sensors 117, between the plurality of the second side sensors 119, and/or between the plurality of the third side sensors 122 in the width direction A2. The second center sensor 116 is located between the plurality of the feed rollers 112 (nip parts N1), the plurality of the first conveyance rollers 120 (nip parts N2), and/or the plurality of the third conveyance rollers 124 (nip parts N3) in the width direction A2. In the example illustrated in FIG. 3, the second center sensor 116 is located at the center position of the medium conveyance path in the width direction A2.

The second center sensor 116 includes a light emitter 116*a* and light receiver 116*b* provided at one side with respect to the medium conveyance path and a light guide provided at a position facing the light emitter 116*a* and light receiver 116*b* with the medium conveyance path in between. The light emitter 116*a* is an LED, etc., and emits light toward the medium conveyance path. On the other hand, the light receiver 116*b* is a photodiode, etc., and receives light emitted by the light emitter 116*a* and guided by the light guide. When there is the medium at a position facing at least one of the light emitter 116*a* and light receiver 116*b*, the light emitted from the light emitter 116*a* is blocked by the medium, so the light receiver 116*b* does not detect the light emitted from the light emitter 116*a*. The second center sensor 116 generates and outputs a second center signal with a signal value changing between the state where there is the medium at the position of the second center sensor 116 and the state where there is no medium based on the intensity of the light which the light receiver 116*b* receives.

The light emitter 116*a* and light receiver 116*b* are located spaced apart in the medium conveyance direction A1 to be located at the same position in the width direction A2. The medium conveyance apparatus 100 can detect the degree of tilt of the medium more accurately by using the second center sensor 116 and the plurality of the first side sensors 117 or the plurality of the second side sensors 119 located at the outside from the second center sensor 116. The light emitter 116*a* and light receiver 116*b* may be located spaced apart in the width direction A2 to be located at different positions in the width direction A2.

The first side sensors 117 are examples of the third sensor and the fourth sensor and the side sensor respectively located at the downstream side from the second sensor in the medium conveyance direction and at the one side and the opposite side of the medium conveyance path in the direction perpendicular to the medium conveyance direction. The first side sensors 117 detect the medium conveyed to their positions of arrangement. In the example illustrated in FIG. 3, two first side sensors 117 are located spaced apart in the width direction A2. The first side sensors 117 are respectively located at the downstream side from the first center sensor 114 and the second center sensor 116 in the medium conveyance direction A1 and at the both sides of the medium conveyance path in the width direction A2 perpendicular to the medium conveyance direction. In particular, the first side sensors 117 are located at the upstream side from the imaging device 123, in particular at the upstream side from the nip parts N2 of the first conveyance rollers 120 and the second conveyance rollers 121, in the medium conveyance direction A1. Further, the first side sensors 117 are located at the insides in the width direction A2 from the maximum size medium in the state stacked on the stacking tray 103 that the medium conveyance apparatus 100 supports, i.e., at the insides from the positions of the inside surfaces of the side guards 103*b* located at the most outer sides. Further, the first side sensors 117 are located at the insides in the width direction A2 of the end positions of the imaging range of the imaging device 123.

The first side sensor 117 includes a light emitter 117*a* and light receiver 117*b* provided at one side with respect to the medium conveyance path and a light guide provided at a position facing the light emitter 117*a* and light receiver 117*b* with the medium conveyance path in between. The light emitter 117*a* is an LED, etc., and emits light toward the medium conveyance path. On the other hand, the light receiver 117*b* is a photodiode, etc., and receives light emitted by the light emitter 117*a* and guided by the light guide. When there is the medium at a position facing at least one of the light emitter 117*a* and light receiver 117*b*, the light emitted from the light emitter 117*a* is blocked by the medium, so the light receiver 117*b* does not detect the light emitted from the light emitter 117*a*. The first side sensor 117 generates and outputs a first side signal with a signal value changing between the state where there is the medium at the position of the first side sensor 117 and the state where there is no medium based on the intensity of the light which the light receiver 117*b* receives.

The light emitter 117*a* and light receiver 117*b* are located spaced apart in the width direction A2 to be located at different positions in the width direction A2. Due to this, the medium conveyance apparatus 100 can monitor the passage of the end part of the medium being conveyed in the broad range region between the light emitter 117*a* and light receiver 117*b*. Therefore, the medium conveyance apparatus 100 can more reliably detect the degree of tilt of the medium even when the stacking position of the medium is off on the stacking tray 103. The light emitter 117*a* and light receiver 117*b* may be located spaced apart in the medium conveyance direction A1 to be located at the same position in the width direction A2. In this case, the medium conveyance apparatus 100 can more accurately detect the degree of tilt of the medium.

The second side sensors 119 are examples of the fifth sensor and side sensor located at the downstream side from the third sensors in the medium conveyance direction and at one side of the medium conveyance path in a direction perpendicular to the medium conveyance direction. The second side sensors 119 detect the medium conveyed to their positions of arrangement. In the example illustrated in FIG. 3, two second side sensors 119 are located spaced apart in the width direction A2. The second side sensors 119 are respectively located at the downstream side from the first center sensor 114, second center sensor 116, and first side sensors 117 in the medium conveyance direction A1 and at the both sides of the medium conveyance path in the width direction A2 perpendicular to the medium conveyance direction. In other words, the second side sensors 119 are located at different positions from the first side sensors 117 in the medium conveyance direction A1. In particular, the second side sensors 119 are located at the upstream side from the imaging device 123, in particular at the upstream side from the nip parts N2 of the first conveyance rollers 120 and the second conveyance rollers 121, in the medium conveyance direction A1. Further, the second side sensors 119 are located at the insides in the width direction A2 from the maximum size medium stacked on the stacking tray 103 that the medium conveyance apparatus 100 supports, i.e., at the insides from the positions of the inside surfaces of the side guards 103*b* located at the most outer sides. Further, the second side sensor 119 are located at the insides in the width direction A2 of the end positions of the imaging range of the imaging device 123. The second side sensors 119 are located at the insides (center side) from the first side sensors 117 in the width direction A2. The second side sensors 119 may be located at the same positions as the first side sensors 117 or at the outsides from the first side sensors 117 in the width direction A2.

The second side sensor 119 includes a light emitter 119*a* and light receiver 119*b* provided at one side with respect to the medium conveyance path and a light guide provided at a position facing the light emitter 119*a* and light receiver 119*b* with the medium conveyance path in between. The light emitter 119*a* is an LED, etc., and emits light toward the medium conveyance path. On the other hand, the light receiver 119*b* is a photodiode, etc., and receives light emitted by the light emitter 119*a* and guided by the light guide. When there is the medium at a position facing at least one of the light emitter 119*a* and light receiver 119*b*, the light emitted from the light emitter 119*a* is blocked by the medium, so the light receiver 119*b* does not detect the light emitted from the light emitter 119*a*. The second side sensor 119 generates and outputs a second side signal with a signal value changing between the state where there is the medium at the position of the second side sensor 119 and the state where there is no medium based on the intensity of the light which the light receiver 119*b* receives.

The light emitter 119*a* and light receiver 119*b* are located spaced apart in the width direction A2 to be located at different positions in the width direction A2. The medium conveyance apparatus 100 can more reliably detect the degree of tilt of the medium. The light emitter 119*a* and light receiver 119*b* may be located spaced apart in the medium conveyance direction A1 to be located at the same position in the width direction A2. In this case, the medium conveyance apparatus 100 can more accurately detect the degree of tilt of the medium.

The third side sensors 122 detect a medium conveyed to their positions of arrangement. In the example illustrated in FIG. 3, two third side sensors 122 are located spaced apart in the width direction A2. The third side sensors 122 are respectively located at the downstream sides from the first side sensors 117 and the second side sensors 119 in the medium conveyance direction A1 and at the both sides of the medium conveyance path in the width direction A2 perpendicular to the medium conveyance direction. In other words, the third side sensors 122 are located at different positions from each of the first side sensors 117 and the second side sensors 119 in the medium conveyance direction A1. In particular, the third side sensors 122 are located at the downstream side from the nip parts N2 of the first conveyance rollers 120 and the second conveyance rollers 121 and the upstream side from the imaging device 123 in the medium conveyance direction A1. Further, the third side sensors 122 are located at the insides in the width direction A2 from the maximum size medium stacked on the stacking tray 103 that the medium conveyance apparatus 100 supports, i.e., at the insides from the positions of the inside surfaces of the side guards 103*b* at the most outer sides. Further, the third side sensor 122 are located at the insides in the width direction A2 of the end positions of the imaging range of the imaging device 123.

The third side sensor 122 includes a light emitter 122*a* and light receiver 122*b* provided at one side with respect to the medium conveyance path and a light guide provided at a position facing the light emitter 122*a* and light receiver 122*b* with the medium conveyance path in between. The light emitter 122*a* is an LED, etc., and emits light toward the medium conveyance path. On the other hand, the light receiver 122*b* is a photodiode, etc., and receives light emitted by the light emitter 122*a* and guided by the light guide. When there is the medium at a position facing at least one of the light emitter 122*a* and light receiver 122*b*, the light emitted from the light emitter 122*a* is blocked by the medium, so the light receiver 122*b* does not detect the light emitted from the light emitter 122*a*. The third side sensor 122 generates and outputs a third side signal with a signal value changing between the state where there is the medium at the position of the third side sensor 122 and the state where there is no medium based on the intensity of the light which the light receiver 122*b* receives.

The light emitter 122*a* and light receiver 122*b* are located spaced apart in the width direction A2 to be located at different positions in the width direction A2. The medium conveyance apparatus 100 can more reliably detect the degree of tilt of the medium. The light emitter 122*a* and the light receiver 122*b* may be located spaced apart in the medium conveyance direction A1 to be located at the same position in the width direction A2. In this case, the medium conveyance apparatus 100 can more accurately detect the degree of tilt of the medium.

At the sensors of the first center sensor 114, the out-of-region sensors 115, the second center sensor 116, the first side sensors 117, the second side sensors 119, and/or the third side sensors 122, instead of light guide, mirrors or other reflection members may be used. Further, at the sensors, the light emitters and light receivers may be provided facing each other with the medium conveyance path in between. Further, the sensors may be contact detection sensors that send a predetermined current when the medium contacts them or when the medium does not contact them, etc. Further, the sensors maybe ultrasonic sensors that detect the presence of the medium by using ultrasound.

Figure 4:
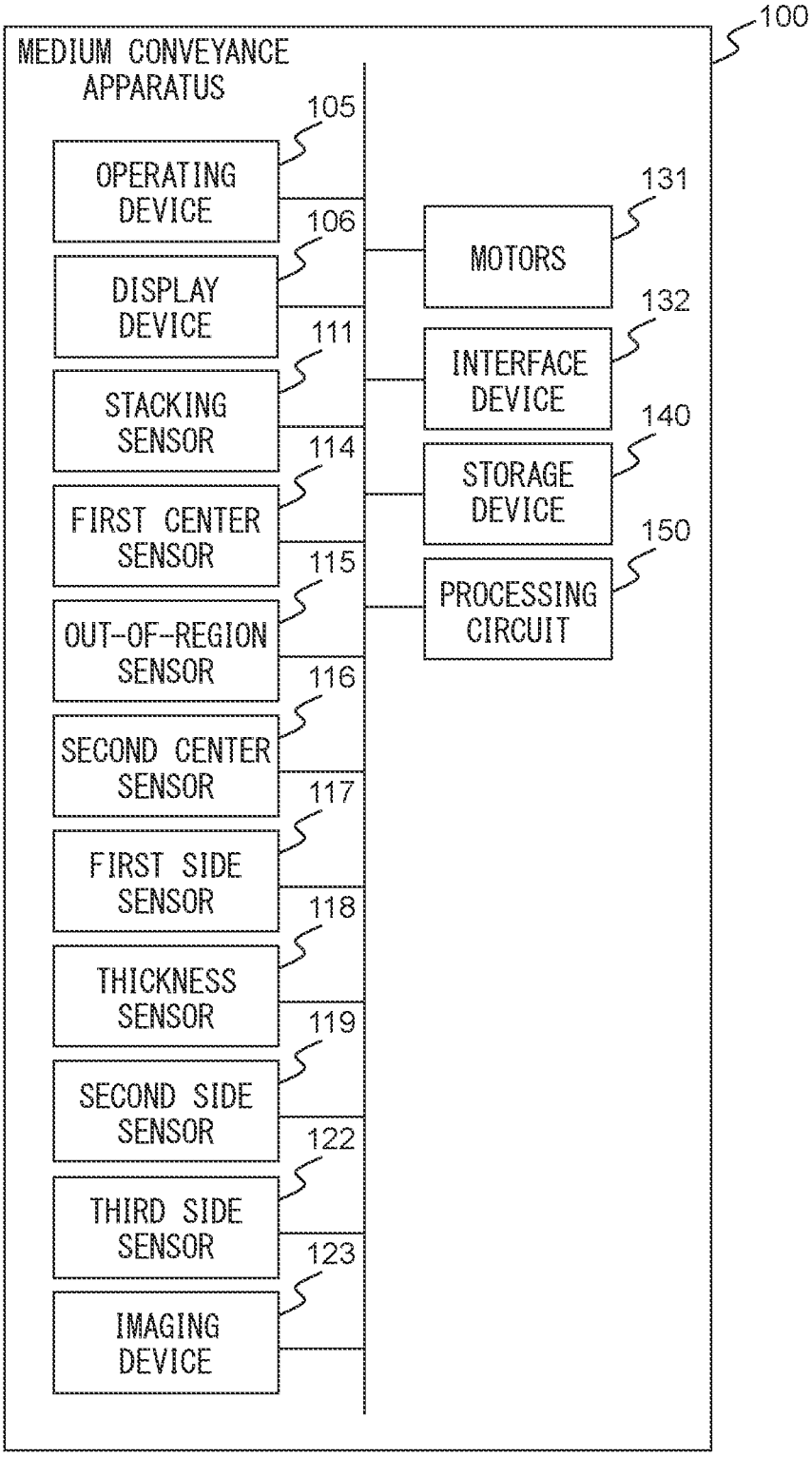
FIG. 4 is a block diagram explaining a schematic configuration of a medium conveyance apparatus according to an embodiment.

FIG. 4 is a block diagram illustrating the schematic constitution of an example of a medium conveyance apparatus.

In addition to the above-mentioned constitution, the medium conveyance apparatus 100 further has motors 131, an interface device 132, a storage device 140, and a processing circuit 150, etc.

The motors 131 include one or more motors and rotate the feed rollers 112, separation rollers 113, first conveyance rollers 120, second conveyance rollers 121, third conveyance rollers 124, and/or fourth conveyance rollers 125 to convey the medium according to the control signals from the processing circuit 150. The motors 131 include separate motors for rotating the feed rollers 112 independently. The motors 131 may include separate motors for rotating the first conveyance rollers 120, second conveyance rollers 121, third conveyance rollers 124, and fourth conveyance rollers 125 independently.

The interface device 132 has an interface circuit conforming to serial bus such as a Universal Serial Bus (USB) and is electrically coupled with an information processing apparatus (for example, a personal computer, mobile information terminal, etc.) to send and receive input images and various information. Further, instead of the interface device 132, a communication device having an antenna sending and receiving wireless signals and a wireless communication interface circuit for transmitting and receiving signals through a wireless communication line conforming to a predetermined communication protocol may be used. The predetermined communication protocol is, for example a wireless Local Area Network (LAN). The communication device may have a wired communication interface circuit for sending and receiving signals through a wired communication line conforming to a wired LAN or other communication protocol.

The storage device 140 has a Random Access Memory (RAM), Read Only Memory (ROM), or other memory device, hard disk or other fixed disk device, flexible disk, optical disk, or other portable storage device, etc. Further, the storage device 140 stores computer programs, databases, tables, etc., used for various processing of the medium conveyance apparatus 100. The computer programs may be installed on the storage device 140 from a computer-readable, non-transitory medium such as a Compact Disc ROM (CD-ROM), Digital Versatile Disc ROM (DVD-ROM), etc., by using a well-known setup program etc. The computer programs may be installed on the storage device 140 from a server, etc.

The storage device 140 stores a cumulative skew condition table, an abnormal skew condition table, etc., as data. The cumulative skew condition table stores cumulative skew conditions for determining whether cumulative skew has occurred. "Cumulative skew" is, among tilted motion where the medium is conveyed tilted, a tilted motion where the tilt angle of the medium being conveyed changes, i.e., tilted motion where the medium moves rotating. The abnormal skew condition table stores the abnormal skew conditions for determining whether abnormal skew has occurred. "Abnormal skew" is, among tilted motion where the medium is conveyed tilted, a tilted motion where the tilt angle of the medium being conveyed does not change, i.e., a tilted motion where the medium moves in parallel in a tilted state. In particular, "abnormal skew" is a tilted motion where there is a possibility of the medium striking a side wall of the medium conveyance path when the medium is advanced continuously with that tilt angle. The "tilted motion where the tilt angle of the medium being conveyed does not change" is not limited to tilted motion where the tilt angle of the medium being conveyed does not change at all and includes a tilted motion where the tilt angle of the medium being conveyed changes by a sufficiently small range of angle (for example, 10 degrees or less). Details of the cumulative skew condition table and the abnormal skew condition table will be explained later.

The processing circuit 150 operates based on programs stored in advance in the storage device 150. The processing circuit is, for example, a Central Processing Unit (CPU). As the processing circuit 160, a Digital Signal Processor (DSP), Large Scale Integrated Circuit (LSI), Application Specific Integrated Circuit (ASIC), Field-Programmable Gate Array (FPGA), etc., may be used.

The processing circuit 150 is connected to the operating device 105, display device 106, stacking sensor 111, first center sensor 114, out-of-region sensors 115, second center sensor 116, first side sensors 117, thickness sensor 118, second side sensors 119, third side sensors 122, imaging device 123, motors 131, interface device 132, storage device 140, etc. and controls these parts. The processing circuit 150 controls the drive operations of the motors 131, controls the imaging operation of the imaging device 123, etc., based on the signals received from the sensors, acquires an input image from the imaging device 123, and sends the input image through the interface device 132 to an information processing device. Further, the processing circuit 150 determines when cumulative skew of the medium and/or abnormal skew has occurred based on the signals received from the sensors.

FIG. 5 is a view presenting one example of the data structure of the cumulative skew condition table.

As presented in FIG. 5, the cumulative skew condition table stores the cumulative skew conditions for determining whether cumulative skew has occurred using the first center sensor 114, second center sensor 116, first side sensors 117, and second side sensors 119. As the cumulative skew conditions, an order condition relating to the order of sensors detecting the (front end of the) medium and a time condition relating to the time from when a number one sensor detects the medium to when a sensor with predetermined number detects the medium. In the example presented in FIG. 5, the cumulative skew condition table is set with a plurality of cumulative skew conditions 1 to 7.

As the order condition of the cumulative skew condition 1, it is set that the first center sensor 114 detects the medium first, one of the plurality of the first side sensors 117 detects the medium second, and the second center sensor 116 detects the medium third. As the time condition of the cumulative skew condition 1, it is set that a first time (time period) from when the number one first center sensor 114 detects the medium to when the number three second center sensor 116 detects the medium is larger than a first threshold value T1. The first threshold value T1 is set in advance to the time between the first time when cumulative skew has occurred and the first time when cumulative skew has not occurred when the medium has been conveyed to satisfy the order condition of the cumulative skew condition 1.

Figure 6A:
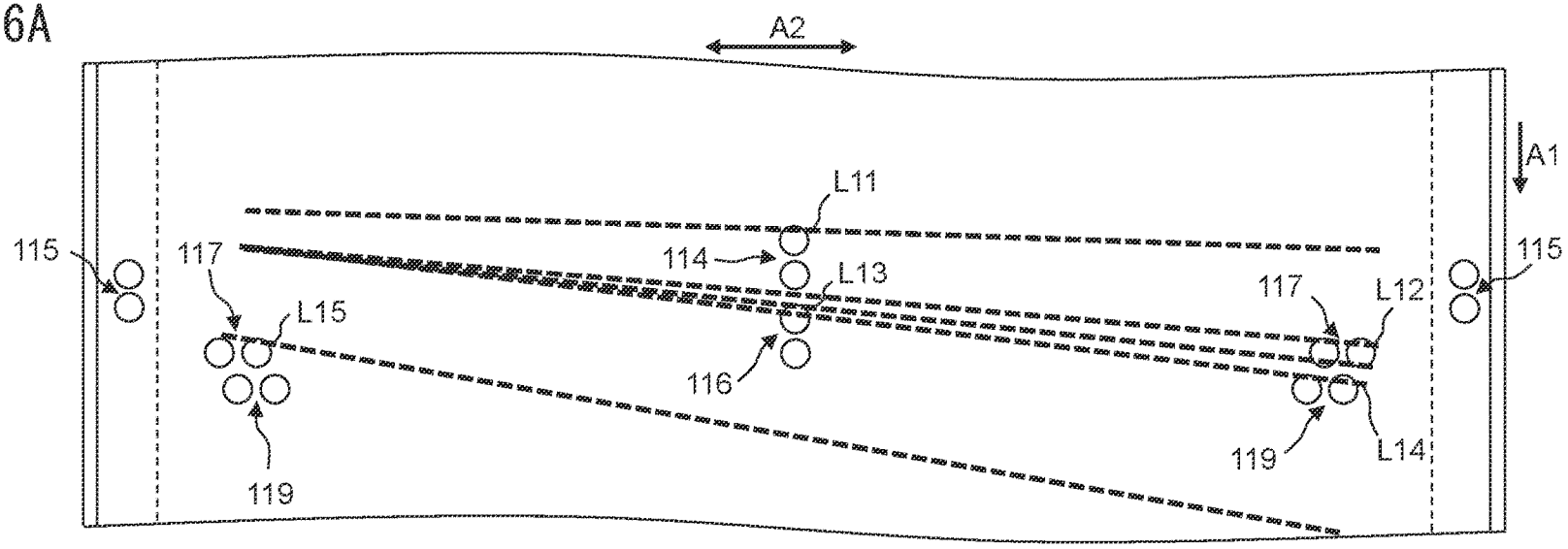
FIG. 6A is a schematic view for explaining cumulative skew.

FIG. 6A is a schematic view for explaining cumulative skew satisfying the cumulative skew conditions 1 to 4. FIG. 6A is a schematic view seen from above of the lower housing 101 with the upper housing 102 opened.

In FIG. 6A, the lines L11 to L15 respectively indicate movement of the front end of the medium in which cumulative skew occurs. The line L11 indicates the front end of the medium when passing through the first center sensor 114. The line L12 indicates the front end of the medium when passing through one of the plurality of the first side sensors 117. The line L13 indicates the front end of the medium when passing through the second center sensor 116. The line L14 indicates the front end of the medium when passing through a sensor located at the same side as the first side sensor 117 which the medium passed through the plurality of the second side sensors 119. The line L15 indicates the front end of the medium when passing through another sensor, i.e., a sensor located at the opposite side to the first side sensor 117 which the medium already passed through the plurality of the first side sensors 117. In this way, when cumulative skew occurs, there is a high possibility that the front end of the medium will not pass through the positions of the sensors in order from the sensors located at the upstream sides, instead of passing through the position of a side sensor located at the downstream side before passing through the position of the center sensor located at the upstream side.

Further, when cumulative skew occurs, the angle of the front end of the medium with respect to the width direction A2 gradually becomes larger. Cumulative skew occurs when paper dust, etc., sticks in large amounts to only one of the plurality of the feed rollers 112 causing a difference in the magnitudes of friction between the plurality of the feed rollers 112 and the medium and causing a difference in the feed force imparted from the feed rollers 112 to the medium. Further, cumulative skew occurs when the preceding sheet of the medium is conveyed tilted and the timings at which the rear end of the preceding sheet of the medium passes through each of the feed rollers 112 differs so that the timings at which each of the feed rollers stars to impart feeding force to the succeeding sheet of the medium 112 differ. In other words, when cumulative skew occurs, suitable feed force is not imparted to the medium from at least one of the plurality of the feed rollers 112. For this reason, the speed by which the medium advances in the medium conveyance direction A1 when cumulative skew has occurred is lower than the speed by which the medium advances in the medium conveyance direction A1 when cumulative skew has not occurred.

Therefore, the medium conveyance apparatus 100 can precisely detect whether cumulative skew has occurred based on the order of the sensors detecting the medium and the interval of the times when the sensors detect the medium.

In the cumulative skew condition 1, it is stated that the front end of the medium moves in the order of the lines L11, L12, and L13 and the time from when the front end of the medium passes through the position of the first center sensor 114 like the line L11 to when the front end of the medium passes through the position of the second center sensor 116 like the line L13 is large.

As the order condition of the cumulative skew condition 2, in addition to the order condition of the cumulative skew condition 1, it is set that a sensor of the plurality of the second side sensors 119 located at the same side as the first side sensor 117 which detected the medium detects the medium fourth. As the time condition of the cumulative skew condition 2, it is set that a second time (time period) from when the number one first center sensor 114 detects the medium to when the number four second side sensor 119 detects the medium is larger than a second threshold value T2. The second threshold value T2 is set in advance to the time between the second time when cumulative skew has occurred and the second time when cumulative skew has not occurred when the medium has been conveyed to satisfy the order condition of the cumulative skew condition 2. In the cumulative skew condition 2, it is stated that the front end of the medium moves in the order of the lines L11, L12, L13, and L14 and the time from when the front end of the medium passes through the position of the first center sensor 114 like the line L11 to when the front end of the medium passes through the position of the second center sensor 119 like the line L14 is large.

As the order condition of the cumulative skew condition 3, in addition to the order condition of the cumulative skew condition 2, it is set that another sensor of the plurality of the first side sensors 117, i.e., a sensor located at the opposite side from the first side sensor 117 which already detected the medium detects the medium fifth. As the time condition of the cumulative skew condition 3, it is set that a third time (time period) from when the number one first center sensor 114 detects the medium to when the number five first side sensor 117 detects the medium is larger than a third threshold value T3. The third threshold value T3 is set in advance to the time between the third time when cumulative skew has occurred and the third time when cumulative skew has not occurred when the medium has been conveyed to satisfy the order condition of the cumulative skew condition 3. In the cumulative skew condition 3, it is stated that the front end of the medium moves in the order of the lines L11, L12, L13, L14, and L15 and the time from when the front end of the medium passes through the position of the first center sensor 114 like the line L11 to when the front end of the medium passes through the position of the first center sensor 117 like the line L15 is large.

As the order condition of the cumulative skew condition 4, in addition to the order condition of the cumulative skew condition 1, it is set that another sensor of the plurality of the first side sensors 117, i.e., a sensor located at the opposite side from the first side sensor 117 which already detected the medium, detects the medium fourth. As the time condition of the cumulative skew condition 4, it is set that a fourth time (time period) from when the number one first center sensor 114 detects the medium to when a number four first side sensor 117 detects the medium is larger than a fourth threshold value T4. The fourth threshold value T4 is set in advance to the time between the fourth time when cumulative skew has occurred and the fourth time when cumulative skew has not occurred when the medium has been conveyed to satisfy the order condition of the cumulative skew condition 4. Depending on the state of conveyance of the medium, there is a possibility that the front end of the medium will not pass through a sensor of the plurality of second side sensors located at the same side as the first side sensor 117 which the medium passed through. Therefore, in the cumulative skew condition 4, compared with the cumulative skew condition 3, it is excluded that the sensor of the plurality of second side sensors 119 located at the same side as the first side sensor 117 detecting the medium detects the medium fourth.

As the order condition of the cumulative skew condition 5, it is set that the first center sensor 114 detects the medium first, one of the plurality of the first side sensors 117 detects the medium second, and a sensor of the plurality of the second side sensors 119 located at the same side as the first side sensor 117 which detected the medium detects the medium third. As the time condition of the cumulative skew condition 5, it is set that a fifth time (time period) from when the number one first center sensor 114 detects the medium to when the number three second side sensor 119 detects the medium is larger than a fifth threshold value T5. The fifth threshold value T5 is set in advance to the time between the fifth time when cumulative skew has occurred and the fifth time when cumulative skew has not occurred when the medium has been conveyed to satisfy the order condition of the cumulative skew condition 5.

Figure 6B:
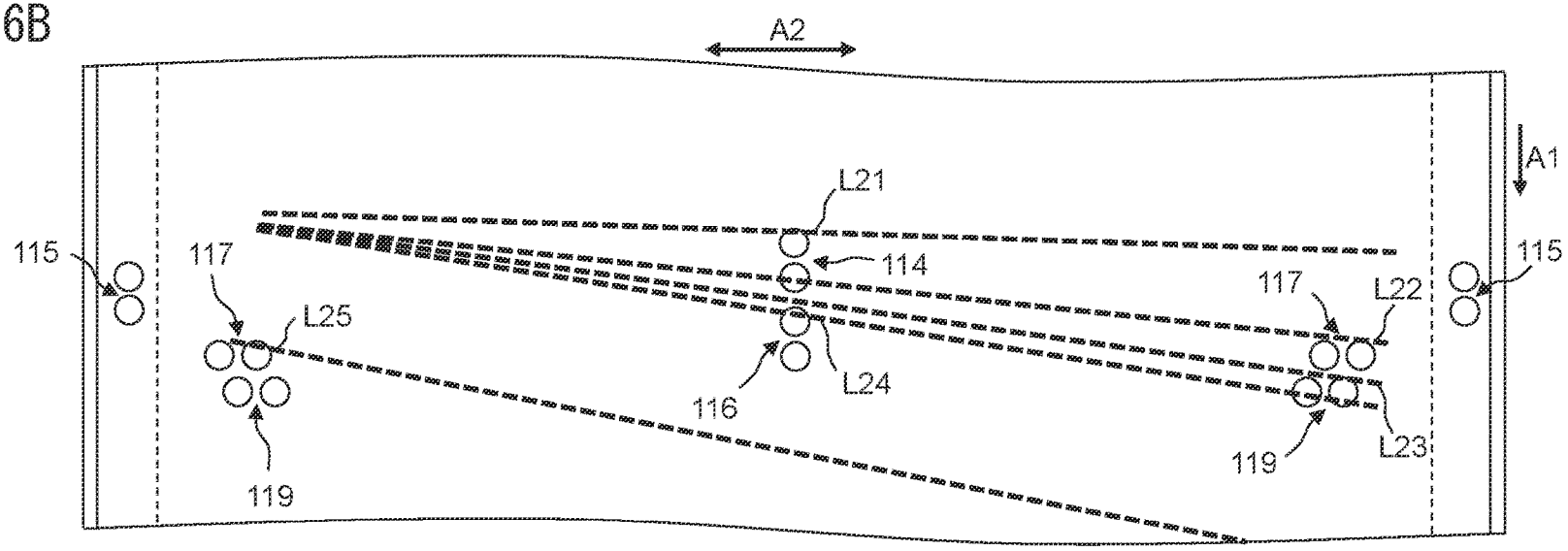
FIG. 6B is a schematic view for explaining cumulative skew.

FIG. 6B is a schematic view for explaining cumulative skew satisfying the cumulative skew conditions 5 to 7. FIG. 6B is a schematic view seen from above of the lower housing 101 with the upper housing 102 opened.

In FIG. 6B, the lines L21 to L25 indicate movement of the front end of the medium in which cumulative skew is occurring. The line L21 indicates the front end of the medium when passing through the first center sensor 114. The line L22 indicates the front end of the medium when passing through one of the plurality of the first side sensors 117. The line L23 indicates the front end of the medium when passing through a sensor of the plurality of the second side sensors 119, located at the same side as the first side sensor 117 which the medium passed through. The line L24 indicates the front end of the medium when passing through the second center sensor 116. The line L25 indicates the front end of the medium when passing through another sensor of the plurality of the first side sensors 117, i.e., a sensor located at the opposite side from the first side sensor 117 which the medium already passed through. In this way, when cumulative skew occurs, there is a possibility of the front end of the medium passing through the position of the second side sensor 119 before passing through the position of the second center sensor 116.

In the cumulative skew condition 5, it is stated that the front end of the medium moves in the order of the lines L21, L22, and L23 and the time from when the front end of the medium passes through the position of the first center sensor 114 like the line L21 to when the front end of the medium passes through the position of the second side sensor 119 like the line L23 is large.

As the order condition of the cumulative skew condition 6, in addition to the order condition of the cumulative skew condition 5, it is set that the second center sensor 116 detects the medium fourth. As the time condition of the cumulative skew condition 6, it is set that a sixth time (time period) from when the number one first center sensor 114 detects the medium to when the number four second center sensor 116 detects the medium is larger than a sixth threshold value T6. The sixth threshold value T6 is set in advance to the time between the sixth time when cumulative skew has occurred and the sixth time when cumulative skew has not occurred when the medium has been conveyed to satisfy the order condition of the cumulative skew condition 6. In the cumulative skew condition 6, it is stated that the front end of the medium moves in the order of the lines L21, L22, L23, and L24 and the time from when the front end of the medium passes through the position of the first center sensor 114 like the line L21 to when the front end of the medium passes through the position of the second center sensor 116 like the line L24 is large.

As the order condition of the cumulative skew condition 7, in addition to the order condition of the cumulative skew condition 6, it is set that another sensor of the plurality of the first side sensors 117, i.e., a sensor located at an opposite side of the first side sensor 117 which already detected the medium detects the medium fifth. As the time condition of the cumulative skew condition 7, it is set that a seventh time (time period) from when the number one first center sensor 114 detects the medium to when the number five first side center sensor 117 detects the medium is larger than a seventh threshold value T7. The seventh threshold value T7 is set in advance to the time between the seventh time when cumulative skew has occurred and the seventh time when cumulative skew has not occurred when the medium has been conveyed to satisfy the order condition of the cumulative skew condition 7. In the cumulative skew condition 7, it is stated that the front end of the medium moves in the order of the lines L21, L22, L23, L24, and L25 and the time from when the front end of the medium passes through the position of the first center sensor 114 like the line L21 to when the front end of the medium passes through the position of the first side sensor 117 like the line L25 is large.

The cumulative skew condition table need only include at least one of the cumulative skew conditions 1 to 7. Other conditions need not be set.

In the medium conveyance apparatus 100, the first center sensor 114 and the second center sensor 116 are located at the center part of the medium conveyance path and at positions differing from each other in the medium conveyance direction A1. For this reason, the first center sensor 114 is located at a position at the upstream side sufficiently apart from the side sensors located at the downstream side from the second center sensor 116. Due to this, the time from when the medium passes through the position of the first center sensor 114 to when it passes through the positions of the side sensors is sufficiently large, so the medium conveyance apparatus 100 can detect the occurrence of cumulative skew with a higher precision based on the interval of the times when the sensors detect the medium. Further, by the second center sensor 116 being provided separately from the first center sensor 114, the medium conveyance apparatus 100 can set the cumulative skew conditions finer and can detect the occurrence of cumulative skew with a higher precision.

FIG. 7 is a view presenting one example of a data structure of the abnormal skew condition table.

As indicated in FIG. 7, in the abnormal skew condition table, abnormal skew conditions for determining that abnormal skew is occurring using the first center sensor 114, second center sensor 116, first side sensors 117, and second side sensors 119 are stored. As the abnormal skew conditions, an order condition relating to the order of the sensors detecting the (front end of the) medium and a time condition relating to the time from when the number one sensor detects the medium to when a sensor with predetermined number detects the medium are set. In the example provided in FIG. 7, at the abnormal skew condition table, the plurality of the abnormal skew conditions 1 to 4 are set.

As the order condition of the abnormal skew condition 1, it is set that one of the plurality of the first side sensors 117 detects the medium first and the first center sensor 114 detects the medium second. The time condition of the abnormal skew condition 1 is not set. In other words, when the order condition of the abnormal skew condition 1 is satisfied, it is determined that the abnormal skew condition 1 has been satisfied regardless of the time from which a specific sensor detects the medium to when another sensor detects the medium.

Figure 8A:
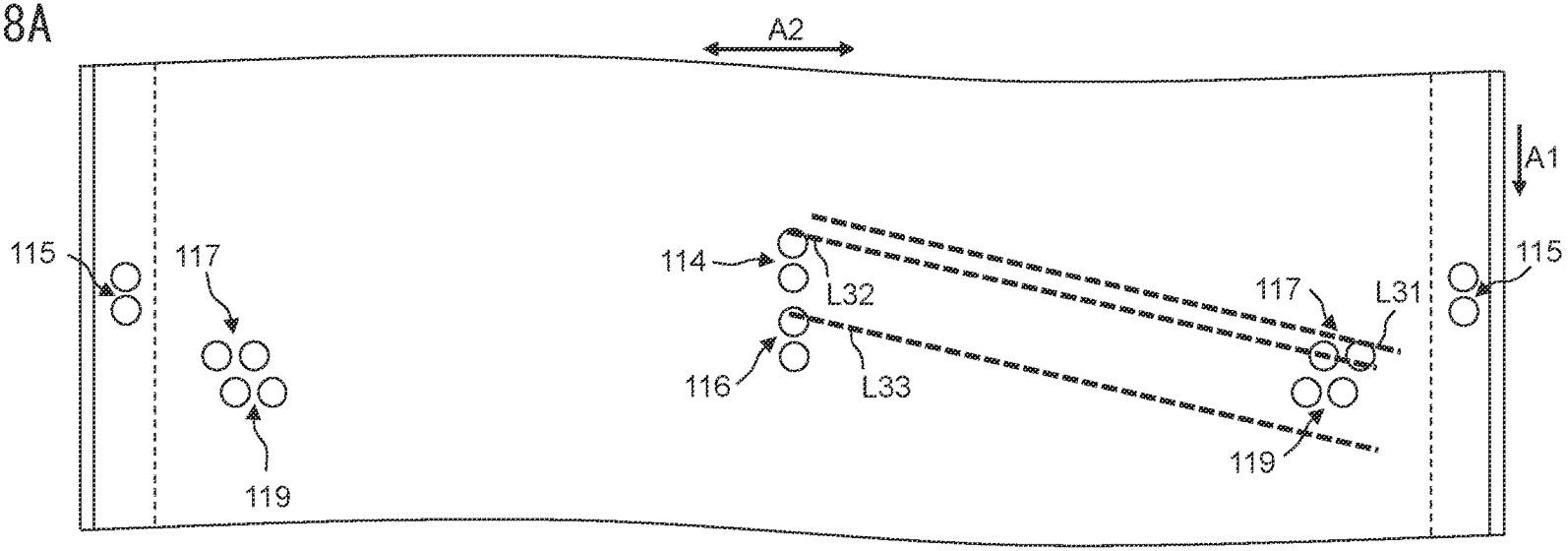
FIG. 8A is a schematic view for explaining abnormal skew.

FIG. 8A is a schematic view for explaining abnormal skew satisfying the abnormal skew conditions 1 to 2. FIG. 8A is a schematic view seen from above of the lower housing 101 in the state with the upper housing 102 opened.

In FIG. 8A, the lines L31 to L33 respectively indicate movement of the front end of the medium at which abnormal skew occurs. The line L31 indicates the front end of the medium when passing through one of the plurality of the first side sensors 117. The line L32 indicates the front end of the medium when passing through the first center sensor 114. The line L33 indicates the front end of the medium when passing through the second center sensor 116. In this way, when abnormal skew has occurred, there is a high possibility that the front end of the medium will greatly tilt and pass through a first side sensor 117 located at the side at the downstream side before passing through the position of the first center sensor 114 located at the center part at the upstream side.

Further, when abnormal skew with a tilt angle of the medium being conveyed not changing occurs, suitable feed force is imparted to the medium from both of the feed rollers 112. For this reason, the speed by which the medium advances in the medium conveyance direction A1 when abnormal skew has occurred is higher than the speed by which the medium advances in the medium conveyance direction A1 when cumulative skew has occurred.

Therefore, the medium conveyance apparatus 100 can suitably determine whether abnormal skew has occurred based on the order of the sensors detecting the medium and the time from which the number one sensor detects the medium to when a specific sensor detects the medium.

In the abnormal skew condition 1, it is stated that the front end of the medium moves in the order of the lines L31 and L32.

As the order condition of the abnormal skew condition 2, it is set that one of the plurality of the first side sensors 117 detects the medium first and the second center sensor 116 detects the medium second. The time condition of the abnormal skew condition 2 is not set. Depending on the state of conveyance of the medium, there is a possibility that the front end of the medium will not pass through the first center sensor 114. Therefore, in the abnormal skew condition 2, compared with the abnormal skew condition 1, it is stated that the second center sensor 116 detects the medium second instead of the first center sensor 114. In the abnormal skew condition 2, it is stated that the front end of the medium moves in the order of the lines L31 and L33 without going through the state of the line L32.

As the order condition of the abnormal skew condition 3, it is set that one of the plurality of the first side sensors 117 detects the medium first, a sensor of the plurality of the second side sensors 119 located at the same side as the first side sensor 117 which detected the medium detects the medium second, and the first center sensor 114 detects the medium third. The time condition of the abnormal skew condition 3 is not set.

Figure 8B:
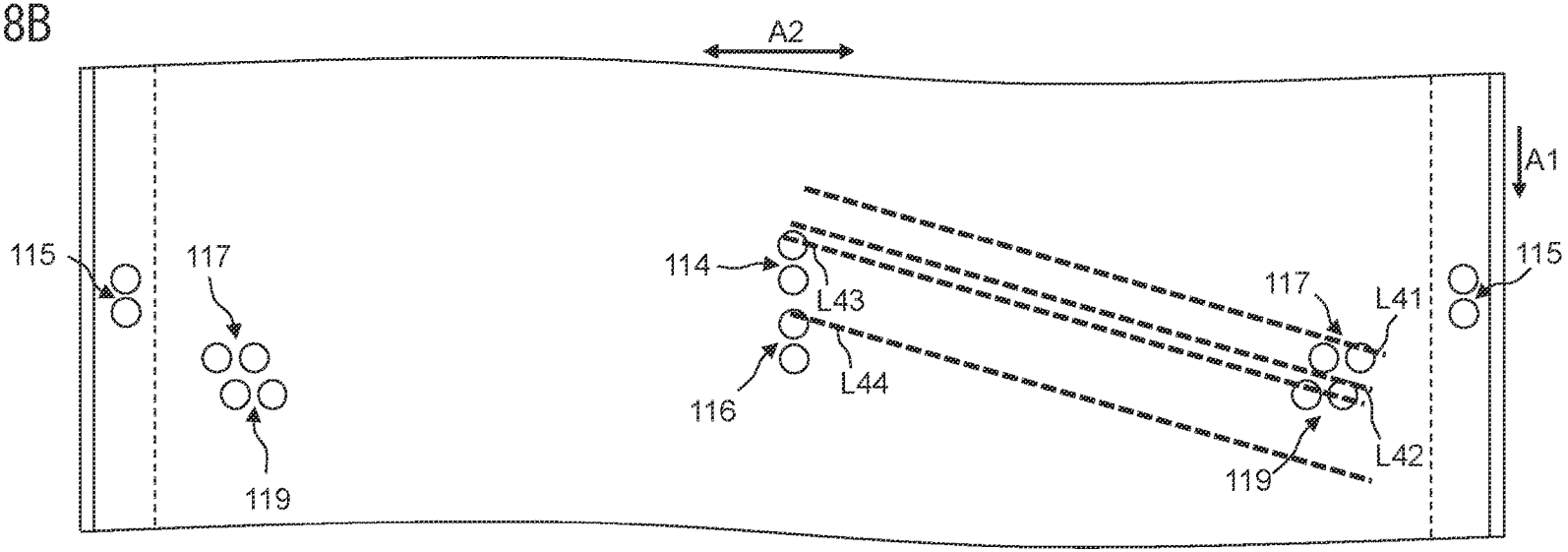
FIG. 8B is a schematic view for explaining abnormal skew.

FIG. 8B is a schematic view for explaining abnormal skew satisfying the abnormal skew conditions 3 to 4. FIG. 8B is a schematic view seen from above of the lower housing 101 in the state with the upper housing 102 opened.

In FIG. 8B, the lines L41 to L44 respectively indicate movement of the front end of the medium at which abnormal skew occurs. The line L41 indicates the front end of the medium when passing through one of the plurality of the first side sensors 117. The line L42 indicates the front end of the medium when passing through a sensor of the plurality of the second side sensors 119 located at the same side as the first side sensor 117 which the medium passed through. The line L43 indicates the front end of the medium when passing through the first center sensor 114. The line L44 indicates the front end of the medium when passing through the second center sensor 116. In this way, if abnormal skew has occurred, there is a possibility that the front end of the medium will greatly tilt and pass through the second side sensor 119 in addition to the first side sensor 117 located at the side at the downstream side before passing through the position of the first center sensor 114 located at the center part at the upstream side.

In the abnormal skew condition 3, it is stated that the front end of the medium moves in the order of the lines L41, L42, and L43.

As the order condition of the abnormal skew condition 4, it is set that one of the plurality of the first side sensors 117 detects the medium first, a sensor of the plurality of the second side sensors 119 located at the same side as the first side sensor 117 which detected the medium detects the medium second, and the second center sensor 116 detects the medium third. The time condition of the abnormal skew condition 4 is not set. Depending on the state of conveyance of the medium, there is a possibility that the front end of the medium will not pass through the first center sensor 114. Therefore, in the abnormal skew condition 4, compared with the abnormal skew condition 3, it is stated that the second center sensor 116 detects the medium third instead of the first center sensor 114. In the abnormal skew condition 4, it is stated that the front end of the medium moves in the order of the lines L41, L42, and L44 without going through the state of the line L43.

The abnormal skew condition table need only include at least one of the abnormal skew conditions 1 to 4. Other conditions need not be set.

In the medium conveyance apparatus 100, the first center sensor 114 and the second center sensor 116 are located at the center part of the medium conveyance path and at positions different from each other in the medium conveyance direction A1. The first center sensor 114 is located at a position at the upstream side sufficiently apart from the side sensors located at the downstream side of the second center sensor 116. For this reason, the medium conveyance apparatus 100 can determine that abnormal skew with a large tilt angle of the medium has occurred when the medium passes through the position of a side sensor before passing through the position of the first center sensor 114.

Figure 9:
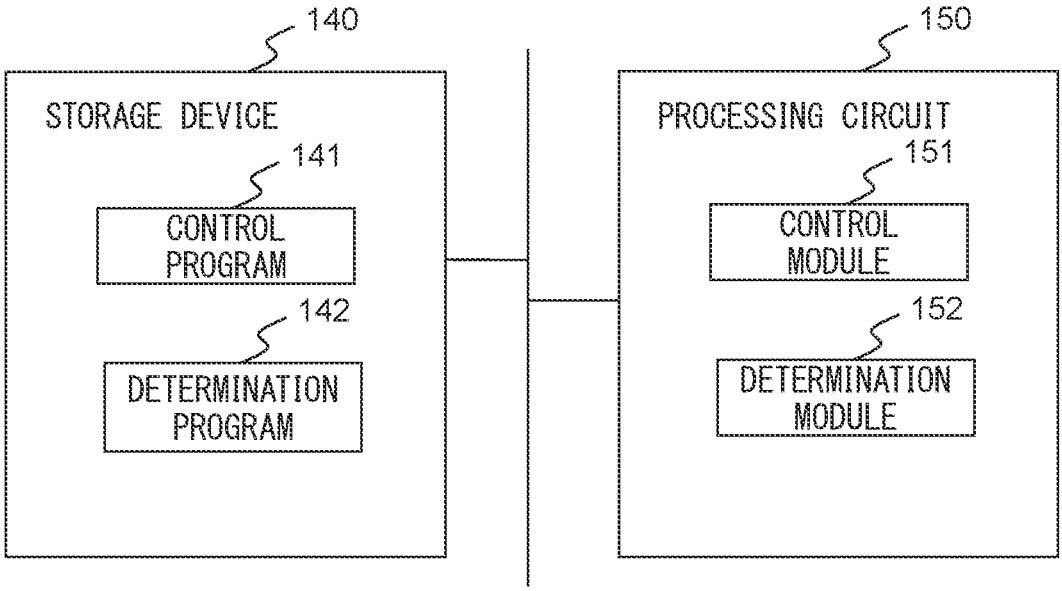
FIG. 9 is a view explaining a schematic configuration of a storage device and a processing circuit according to an embodiment.

FIG. 9 is a view illustrating the schematic constitution of the storage device 140 and the processing circuit 150.

As illustrated in FIG. 9, the storage device 140 stores a control program 141, a determination program 142, etc. These programs are function modules loaded by software operating on a processor. The processing circuit 160 reads the programs stored in the storage device 150 and operates in accordance with the read programs. The processing circuit 150 functions as the control module 151 and the determination module 152.

Figure 10:
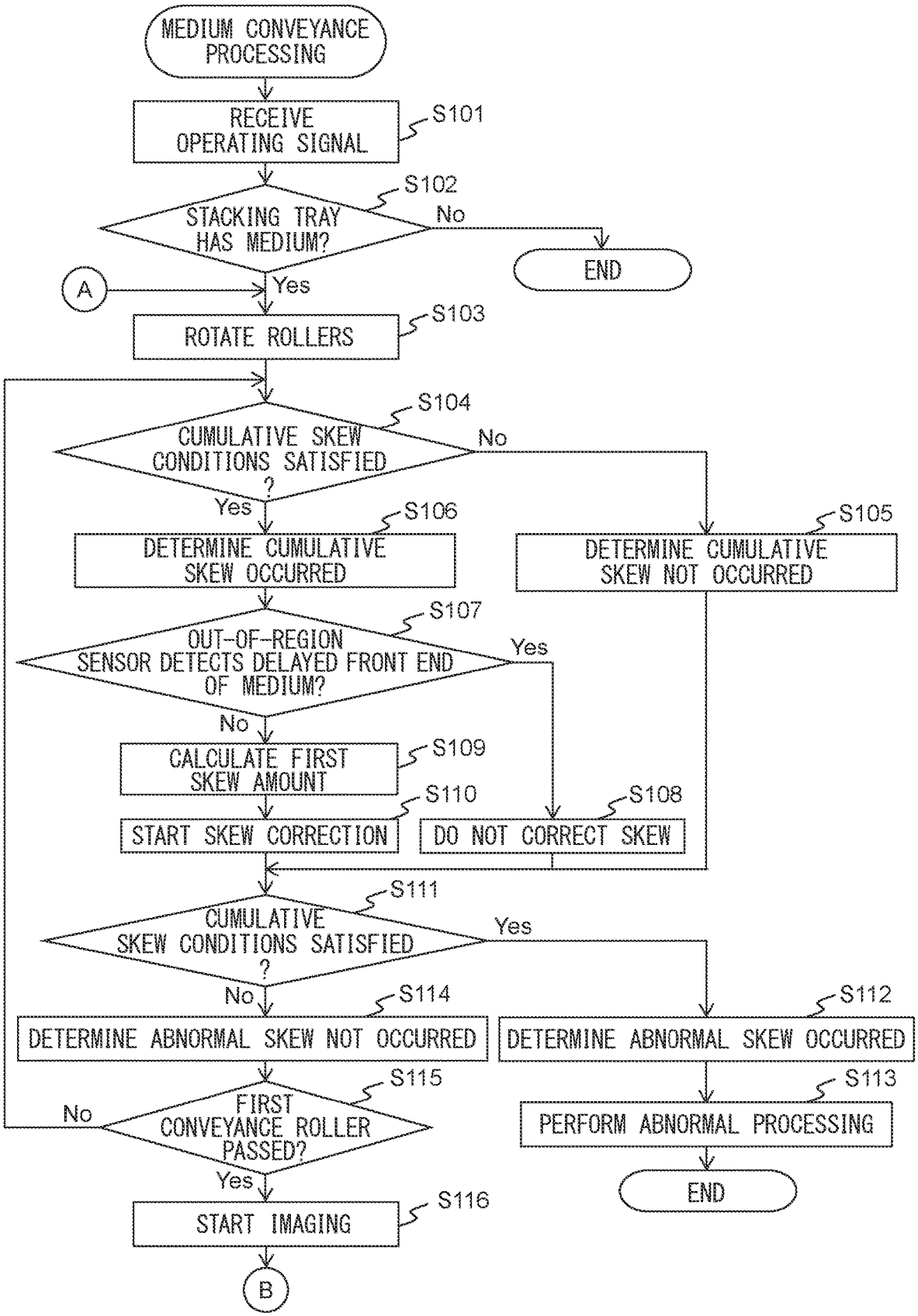
FIG. 10 is a flow chart explaining an example of operation of medium reading processing.
Figure 11:
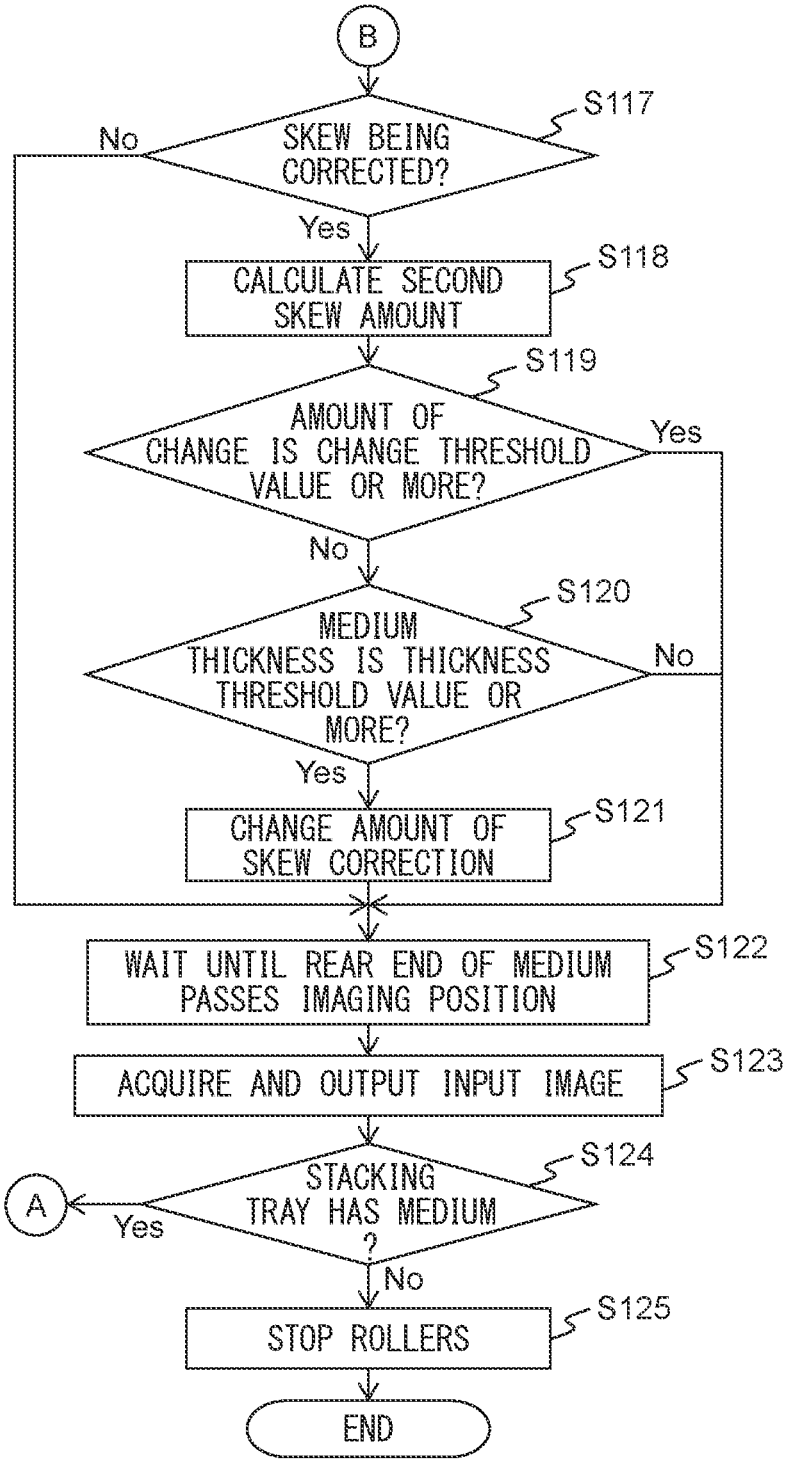
FIG. 11 is a flow chart explaining an example of operation of medium reading processing.

FIG. 10 and FIG. 11 are flow charts presenting an example of the operations in the medium reading processing of the medium conveyance apparatus 100.

An example of the operations in the medium reading processing of the medium conveyance apparatus 100 will be explained below in reference to the flow charts presented in FIG. 10 and FIG. 11. Note that, the flow of the operations explained below is performed, based on a program stored in advance in the storage device 140, mainly by the processing circuit 150 in cooperation with the elements of the medium conveyance apparatus 100.

First, the control module 151 waits until an instruction to read a medium is input by a user using the operating device 105 or an information processing apparatus and receiving an operating signal instructing reading of the medium from the operating device 105 or interface device 132 (step S101).

Next, the control module 151 acquires a medium signal from the first medium sensor 111 and determines whether the stacking tray 103 has the medium based on the acquired medium signal (step S102). If the stacking tray 103 does not have the medium, the control module 151 ends the series of processing.

On the other hand, when the stacking tray 103 has the medium stacked on it, the control module 151 drives the motors 131. The control module 151 rotates the feed rollers 112, separation rollers 113, first conveyance rollers 120, second conveyance rollers 121, third conveyance rollers 124, and/or fourth conveyance rollers 125 to feed and convey the medium (step S103).

Next, the determination module 152 determines whether any of the cumulative skew conditions stored in the cumulative skew condition table has been satisfied (step S104). The determination module 152 periodically receives first center signals, second center signals, first side signals, and second side signals from the first center sensor 114, second center sensor 116, first side sensors 117, and second side sensors 119. The determination module 152 determines that the front end of the medium has passed through the positions of the sensors sending the signals when the signal values of the signals change from values indicating that there is no medium to values indicating that there is the medium. The determination module 152 stores the order of passage and time of passage of the sensors in the storage device 140 when the front end of the medium passes through the positions of the sensors. The determination module 152 determines whether the order of passage and time of passage stored in the storage device 140 satisfy the order of passage and time of passage of the cumulative skew condition for each of the plurality of the cumulative skew conditions stored in the cumulative skew condition table.

When no cumulative skew condition is satisfied, the determination module 152 determines that cumulative skew of the medium has not occurred (step S105) and shifts the processing to step S111.

On the other hand, when any of the cumulative skew condition was satisfied, the determination module 152 determines that cumulative skew of the medium has occurred (step S106).

In this way, the determination module 152 determines that cumulative skew of the medium has occurred by determining whether a cumulative skew condition has been satisfied. In other words, the determination module 152 determines whether the tilt angle of the medium being conveyed has changed based on which one of sensors detected the medium first, second, and third. Furthermore, the determination module 152 determines whether the tilt angle of the medium being conveyed is changing based on the total of the interval of the times when the sensors detect the medium, i.e., at least the time from when the sensor detected the medium first detects the medium to when the sensor detected the medium third detects the medium.

In particular, the determination module 152 determines whether the cumulative skew condition 1 has been satisfied to thereby determine whether cumulative skew of the medium has occurred. In other words, the determination module 152 determines whether the tilt angle of the medium being conveyed has changed based on the first time from when the first center sensor 114 detects the medium to when the second center sensor 116 detects the medium when the first center sensor 114 detects the medium first, one of the plurality of the first side sensors 117 detects the medium second, and the second center sensor 116 detects the medium third.

Further, the determination module 152 determines whether the cumulative skew condition 3 or the cumulative skew condition 4 has been satisfied to thereby determine whether cumulative skew of the medium has occurred. In other words, the determination module 152 determines whether the tilt angle of the medium being conveyed has changed based on the third time or the fourth time from when the first center sensor 114 detects the medium to when another sensor of the plurality of the first side sensors 117 detects the medium when the first center sensor 114 detects the medium first, one of the plurality of the first side sensors 117 detects the medium second, the second center sensor 116 detects the medium third, then another sensor of the plurality of first side sensors 117 detects the medium.

Further, the determination module 152 determines whether the cumulative skew condition 5 has been satisfied to thereby determine whether cumulative skew of the medium has occurred. In other words, the determination module 152 determines whether the tilt angle of the medium being conveyed has changed based on the fifth time from when the first center sensor 114 detects the medium to when the second side sensor 119 detects the medium when the first center sensor 114 detects the medium first, one of the plurality of the first side sensors 117 detects the medium second, and a sensor of the plurality of the second side sensors 119 located at the same side as the first side sensor 117 detecting the medium second detects the medium third.

Due to these, the determination module 152 can determine that the tilt angle of the medium being conveyed has changed early and with a high precision.

Next, the determination module 152 determines whether the out-of-region sensor 115 has detected an end part of a side of the medium delayed in advance (step S107). The determination module 152 periodically receives out-of-region signals from the plurality of the out-of-region sensors 115. The determination module 152 determines that the end part of the medium has passed through the position of the out-of-region sensor 115 when the signal value of any out-of-region signal received from the out-of-region sensor 115 located at the opposite side of the first side sensor 117 detecting the medium earlier indicates that there is the medium. In this case, the determination module 152 determines that the out-of-region sensor 115 has detected the end part of a side of the medium delayed in advance.

When the out-of-region sensor 115 has detected the end part of a side of the medium delayed in advance, the determination module 152 shifts the processing to step S111 without performing correction of the skew of the medium (step S108).

Figure 12A:
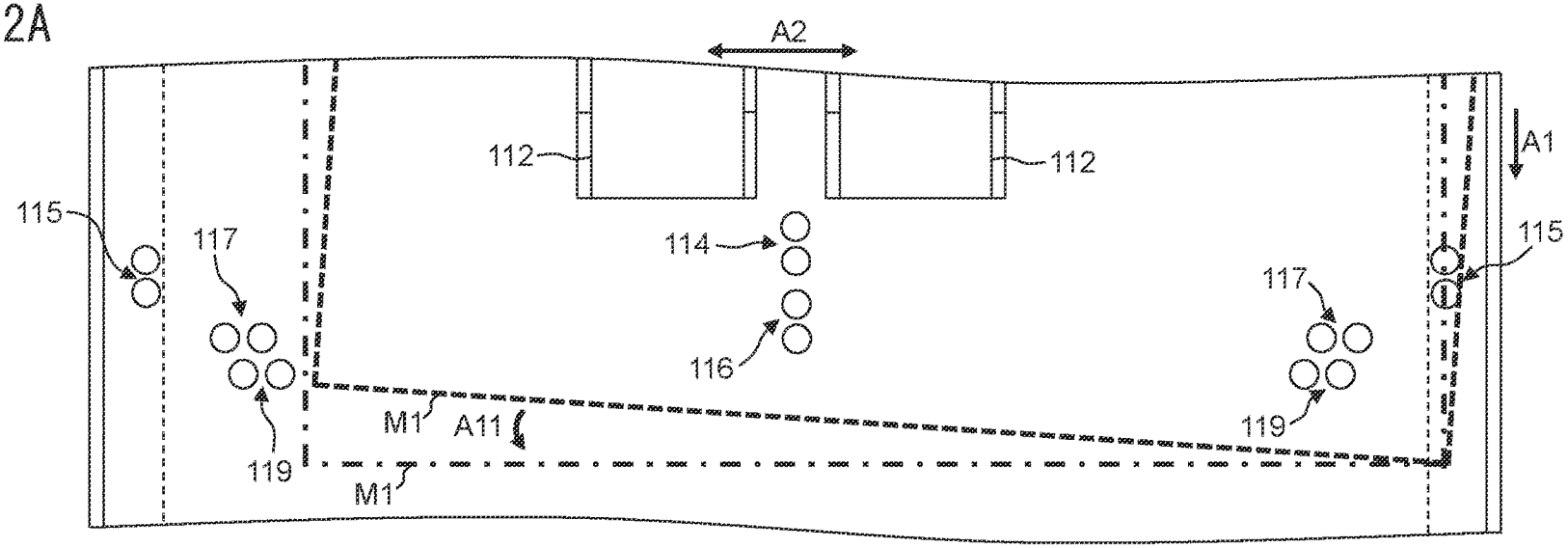
FIG. 12A is a schematic view illustrating a state where an end part of the medium passes through a position of an out-of-region sensor 115.
Figure 12B:
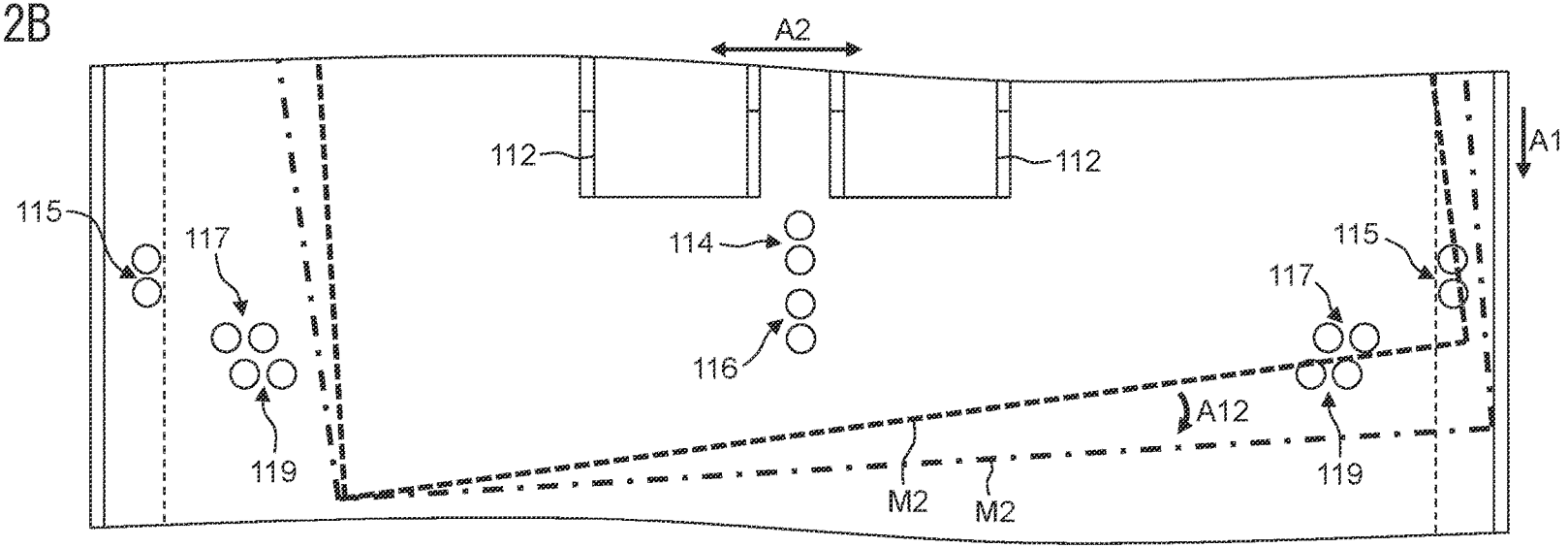
FIG. 12B is a schematic view illustrating a state where an end part of the medium passes through a position of an out-of-region sensor 115.

FIGS. 12A and 12B are schematic views explaining the states of an end part of a medium passing through positions of out-of-region sensors 115. FIGS. 12A and 12B are schematic views seen from above of the lower housing 101 in the state with the upper housing 102 opened.

The broken line of FIG. 12A indicates the medium M1 conveyed so that the right side part of the front end proceeds first and the right end passes through the right side out-of-region sensor 115. To correct tilt of the medium M1, it is necessary to make the peripheral speed of the feed roller 112 located at the delayed side higher than the peripheral speed of the feed roller 112 located at the preceding side so that the delayed side (left side) of the medium advances more than the preceding side (right side). In this case, as indicated by the one-dot chain line, the medium M1 rotates in the direction of the arrow A11 of FIG. 12A and the right end of the medium M1 moves (rotates) in a direction away from the side wall at the right side of the medium conveyance path.

The broken line of FIG. 12B indicates the medium M2 conveyed tilted so that the left side part of the front end proceeds first and the right end passes through the right side out-of-region sensor 115. To correct tilt of the medium M2, it is necessary to make the peripheral speed of the feed roller 112 located at the delayed side higher than the peripheral speed of the feed roller 112 located at the preceding side so that the delayed side (right side) of the medium advances more than the preceding side (left side). In this case, as indicated by the one-dot chain line, the medium M2 rotates in the direction of the arrow A12 of FIG. 12B and the right end of the medium M2 moves (rotates) in a direction approaching the side wall at the right side of the medium conveyance path. As a result, there is a possibility of the right end of the medium M2 striking the side wall of the right side of the medium conveyance path and jamming of the medium occurring.

In this way, when correction of skew of the medium is performed when the out-of-region sensor 115 has detected the end part at the side of the medium delayed in advance, there is a possibility of the end part at the side of the medium delayed in advance striking a side wall of the medium and jamming of the medium occurring. The determination module 152 can suppress occurrence of jamming of the medium by not performing correction of skew of the medium when the out-of-region sensor 115 has detected an end part of the medium delayed in advance.

On the other hand, when the out-of-region sensor 115 has not detected the end part at the side of the medium delayed in advance, the determination module 152 calculates the first amount of skew of the medium (step S109). The determination module 152 calculates as the first amount of skew the time from when the first side sensor 117 located at the preceding side detects the front end of the medium to when the first side sensor 117 located at the side of the medium delayed in advance detects the front end of the medium. The determination module 152 may calculate as the first amount of skew the distance obtained by multiplying the above time with the speed of conveyance of the medium. Further, the determination module 152 may calculate as the first amount of skew the divided value of the above distance divided by the distance between the plurality of the first side sensors 117 or the arctangent of that divided value. Further, the determination module 152 may calculate the first amount of skew using the timings at which the second side sensors 119 detect the medium instead of the timings at which the first side sensors 117 detect the medium.

Next, the control module 151 starts the correction of skew of the medium (step S110). The control module 151 makes the peripheral speeds of the plurality of the feed rollers 112 different from each other to correct skew of the medium. The control module 151 changes the peripheral speeds of the feed rollers 112 so that the peripheral speed of the feed roller 112 located at the side of the medium delayed in advance at the width direction A2 is faster (higher) than the peripheral speed of the feed roller 112 located at the preceding side. The control module 151 makes the peripheral speed of the feed roller 112 located at the side of the medium delayed in advance faster (higher) and/or makes the peripheral speed of the feed roller 112 located at the preceding side slower (lower). The control module 151 sets the peripheral speeds so that the difference between the peripheral speed of the feed roller 112 located at the side of the medium delayed in advance and the peripheral speed of the feed roller 112 located at the preceding side is greater the larger the first amount of skew. The medium rotates about the feed roller 112 located at the preceding side, so skew of the medium is eliminated.

Next, the determination module 152 determines whether any abnormal skew condition stored in the abnormal skew condition table has been satisfied (step S111). The determination module 152 determines whether the order of passage and the time of passage stored in the storage device 140 are satisfied for each of the plurality of the abnormal skew conditions stored in the abnormal skew condition table.

When any abnormal skew condition was satisfied, the determination module 152 determines that abnormal skew of the medium has occurred (step S112).

Next, the control module 151 performs the abnormality processing of the medium (step S113) and ends the series of steps. As abnormality processing, the control module 151 stops the motors 131 to stop the feed and conveyance of the medium. Further, as abnormality processing, the control module 151 displays information indicating the occurrence of abnormal skew of the medium on the display device 106 or notifies the user by sending it to an information processing device through the interface device 132.

On the other hand, when none of the abnormal skew conditions has satisfied at step S111, the determination module 152 determines the abnormal skew of the medium has not occurred (step S114).

In this way, the determination module 152 determines whether the abnormal skew condition 1 has satisfied to thereby determine whether abnormal skew of the medium has occurred. In other words, the determination module 152 determines that skew has occurred where the tilt angle of the medium being conveyed does not change when one of the plurality of the first side sensors 117 detects the medium before the first center sensor 114 detects the medium.

Further, the determination module 152 determines whether the abnormal skew condition 3 was satisfied to thereby determine whether abnormal skew of the medium has occurred. In other words, the determination module 152 determines that skew is occurring where the tilt angle of the medium being conveyed does not change when one of the plurality of the second side sensors 119 detects the medium before the first center sensor 114 detects the medium.

The determination module 152 can determine that the medium being conveyed will strike a side wall of the conveyance path early and precisely.

Next, the determination module 152 determines whether the front end of the medium has passed through the positions of the first conveyance roller 120 and the second conveyance roller 121 (step S115). The determination module 152 periodically acquires the third side signals from the third side sensors 122. The determination module 152 determines that the front end of the medium has passed through the positions of the first conveyance roller 120 and the second conveyance roller 121 when the signal value of any of the third side signals changes from a value indicating that there is no medium to a value indicating that there is the medium. The determination module 152 may determine that the front end of the medium has passed through the positions of the first conveyance roller 120 and the second conveyance roller 121 when a predetermined time from starting the feed of the medium has elapsed. When the front end of the medium has still not passed through the positions of the first conveyance roller 120 and the second conveyance roller 121, the determination module 152 returns the processing to step S104 and repeats the processing from step S104 on.

On the other hand, when the front end of the medium passes through the positions of the first conveyance roller 120 and the second conveyance roller 121, the control module 151 causes the imaging device 123 to start capturing the medium (step S116).

Next, the determination module 152 determines whether correction of skew is currently underway (step S117). The determination module 152 determines whether correction of skew is currently underway depending on whether the control module 151 started correction of the skew at step S110. When correction of skew is not underway, the determination module 152 shifts the processing to step S122.

On the other hand, when correction of skew is underway, the determination module 152 calculates the second amount of skew of the medium (step S118). The determination module 152 calculates as the second amount of skew the time from when the third side sensor 122 located at the preceding side detects the front end of the medium to when the third side sensor 122 located at the side of the medium delayed in advance detects the front end of the medium.

The determination module 152 may calculate as the second amount of skew the time from when the first side sensor 117 located at the preceding side detects the rear end of the medium to when the first side sensor 117 located at the side of the medium delayed in advance detects the rear end of the medium. Further, the determination module 152 may calculate as the second amount of skew the time from when the third side sensor 122 located at the preceding side detects the rear end of the medium to when the third side sensor 122 located at the side of the medium delayed in advance detects the rear end of the medium. Further, the determination module 152 may calculate as the second amount of skew the distance of the above time multiplied with the speed of conveyance of the medium. Further, the determination module 152 may calculate as the second amount of skew the divided value of the above distance divided by the distance between the plurality of the third side sensors 122 or the arctangent of that divided value.

Next, the determination module 152 determines whether the amount of change of the first amount of skew calculated at step S109 and the second amount of skew calculated at step S118 is a change threshold value or more (step S119). The determination module 152 calculates as the amount of change the subtracted value of the first amount of skew minus the second amount of skew or the divided value of the first amount of skew divided by the second amount of skew. The determination module 152 determines that the amount of skew correction is suitable and shifts the processing to step S122 without changing the amount of skew correction when the amount of change is the change threshold value or more. On the other hand, the determination module 152 determines that the amount of skew correction is insufficient when the amount of change is less than the change threshold value. The change threshold value is set by advance experiments to a value between the amount of change when the skew of the medium is suitably corrected and the amount of change when the skew of the medium is not suitably corrected.

When the amount of change is less than the change threshold value, the determination module 152 determines whether the thickness of the medium conveyed is a thickness threshold value or more (step S120). The determination module 152 periodically acquires thickness signals from the thickness sensor 118. When the thickness sensor 118 is an ultrasonic sensor the determination module 152 determines that the thickness of the medium is the thickness threshold value or more when the signal value of any thickness signal is a predetermined threshold value or less. The thickness threshold value is, for example, set to a value between the thickness of regular paper of a PPC (plain paper copier) and the thickness of thin paper. The predetermined threshold value is set to a signal value of the thickness signal in the case where the thickness of the conveyed medium is the thickness threshold value. When the thickness sensor 118 is a reflective light sensor, pressure sensor, or movement sensor, the determination module 152 determines that the thickness of the medium is the thickness threshold value or more when the signal value of any thickness signal is a predetermined threshold value or more. The determination module 152 determines that the medium conveyed is thin paper and shifts the processing to step S122 without changing the amount of skew correction when the thickness of the medium is less than the thickness threshold value. The medium conveyance apparatus 100 can suppress that a medium with low strength such as thin paper is forcibly rotated and the medium is damaged. On the other hand, the determination module 152 determines that the conveyed medium is not thin paper when the thickness of the medium is the thickness threshold value or more.

When the thickness of the medium is the thickness threshold value or more, the control module 151 changes the amount of skew correction (step S121). The control module 151 makes the amount of skew correction larger than the current amount of skew correction. The control module 151 sets the peripheral speeds so that the difference between the peripheral speed of the feed roller 112 located at the side of the medium delayed in advance and the peripheral speed of the feed roller 112 located at the preceding side becomes larger than the difference set at step S110. When not possible to sufficiently correct skew of the medium by the initially set amount of skew correction, the control module 151 can increase the amount of skew correction to thereby more reliably correct skew of the medium. The control module 151 can suppress that the medium is captured in a tilted state and imaging dropping where part of the medium (corner) is not included in the input image occurs. Further, the control module 151 can change the amount of skew correction in steps so that it suppresses that the skew is overly corrected, jamming or damage of the medium occurs and the speed of conveyance of the medium falls.

Next, the control module 151 waits until the rear end of the medium passes through the imaging position of the imaging device 123 (step S122). The control module 151 periodically acquires third side signals from the third side sensors 122. The control module 151 determines that the rear end of the medium has passed through the position of a third side sensor 122 when the signal value of the third side signal changes from a value indicating that there is the medium to a value indicating that there is no medium. The control module 151 determines that the rear end of the medium has passed through the imaging position when a predetermined time has elapsed from when the rear end of the medium passes through the position of any third side sensor 122. The predetermined time is set to the time required for the medium to move from the position of the third side sensor 122 to the imaging position of imaging device 123. The control module 151 may determine that the rear end of the medium has passed through the imaging position when a predetermined time has elapsed from when starting to feed the medium.

Next, the control module 151 acquires an input image from the imaging device 123 and sends the acquired input image to the information processing device through the interface device 132 to output it (step S123).

Next, the control module 151 determines whether the stacking tray 103 has the medium remaining on it based on the stacking signal acquired from the stacking sensor 111 (step S124). When the stacking tray 103 has the medium remaining on it, the control module 151 returns the processing to step S103 and repeats the processing of steps S103 to S124.

On the other hand, when the stacking tray 103 does not have the medium remaining on it, the control module 151 stops the motors 131. The control module 151 stops the feed roller 112, the separation roller 113, first conveyance roller 120, second conveyance roller 121, third conveyance roller 124, and/or fourth conveyance roller 125 (step S125). Further, the control module 151 ends the series of steps.

The processing of steps S104 to S110 may be omitted and the determination module 152 need not determine whether cumulative skew of the medium has occurred. Further, the processing of steps S107 to S108 may be omitted and the control module 151 may perform correction of skew of the medium regardless of the out-of-region sensor 115 detecting the end part at the side where advance of the medium is delayed. Further, the processing of steps S111 to S114 may be omitted and the determination module 152 need not determine whether abnormal skew of the medium has occurred. Further, the processing of steps S117 to S121 may be omitted and the control module 151 need not change the amount of correction of skew. Further, the processing of step S119 may be omitted and the control module 151 may change the amount of correction of skew of the medium regardless of whether the amount of change is the change threshold value or more. Further, the processing of step S120 may be omitted and the control module 151 may change the amount of correction of skew of the medium regardless of whether the thickness of the medium is the thickness threshold value or more.

Further, the control module 151 may receive the settings as to whether to perform the processing of steps S104 to S110, S107 to S108, S111 to S114, S117 to S121, S119, or S120 by the user using the operating device 105 or an information processing device.

Further, when the first amount of skew calculated at step S109 is larger than the skew threshold value, the control module 151 may perform abnormality processing and end the series of steps without performing correction of skew of the medium. The skew threshold value is, for example, set to the average value, center value, minimum value, etc., of the first amount of skew when the medium strikes a side wall of the medium conveyance path when continuing conveyance of the medium in advance experiments. The medium conveyance apparatus 100 can suppress that the medium forcibly rotates and the medium is damaged.

As explained above in detail, in the medium conveyance apparatus 100, one or more sensors are located at the center part and/or sides of the medium conveyance path. The medium conveyance apparatus 100 determines whether the tilt angle of the medium being conveyed has changed based on the time from when any sensor detects the medium to when another sensor detects the medium. The medium conveyance apparatus 100 can suitably determine whether the tilt angle of the medium being conveyed has changed.

In particular, the medium conveyance apparatus 100 can detect cumulative skew of the medium has occurred early and suitably correct cumulative skew of the medium to improve the processing performance of the medium reading processing.

Further, the medium conveyance apparatus 100 can stably convey the medium regardless of how the medium is set on the stacking tray 103 by the user to improve productivity of the input image. The user no longer is required to perform the work of aligning the front ends of the medium, the work of aligning the end parts of media differing in sizes with each other, etc., when setting the medium on the stacking tray 103. The medium conveyance apparatus 100 can improve user convenience.

FIGS. 13A and 13B are views presenting examples of the data structures of the cumulative skew condition table and the abnormal skew condition table in the medium conveyance apparatus according to another embodiment.

In the cumulative skew condition table according to another embodiment, in addition to the cumulative skew conditions 1 to 7 provided in FIG. 5, the cumulative skew conditions 8 to 9 provided in FIG. 13A are set. Further, in the abnormal skew condition table, instead of the abnormal skew conditions 1 to 4 provided in FIG. 7, the abnormal skew conditions 1 to 2 provided in FIG. 13B are set.

As the order condition of the cumulative skew condition 8, it is set that one of the plurality of the first side sensors 117 detects the medium first, the first center sensor 114 detects the medium second, a sensor of the plurality of the second side sensors 119 located at the same side as the first side sensor 117 which detected the medium detects the medium third, and the second center sensor 116 detects the medium fourth. As the time condition of the cumulative skew condition 8, it is set that an eighth time (time period) from when the number one first side sensor 117 detects the medium to when the number four second center sensor 116 detects the medium is larger than an eighth threshold value T8. The eighth threshold value T8 is set in advance to the time between the eighth time when cumulative skew has occurred and the eighth time when abnormal skew has occurred when the medium has been conveyed to satisfy the order condition of the cumulative skew condition 8.

On the other hand, as the order condition of the abnormal skew condition 1, a condition the same as the order condition of the cumulative skew condition 8 is set. However, as the time condition of the abnormal skew condition 1, it is set that the eighth time from when the number one first side sensor 117 detects the medium to when the number four second center sensor 116 detects the medium is the eighth threshold value T8 or less.

Figure 14A:
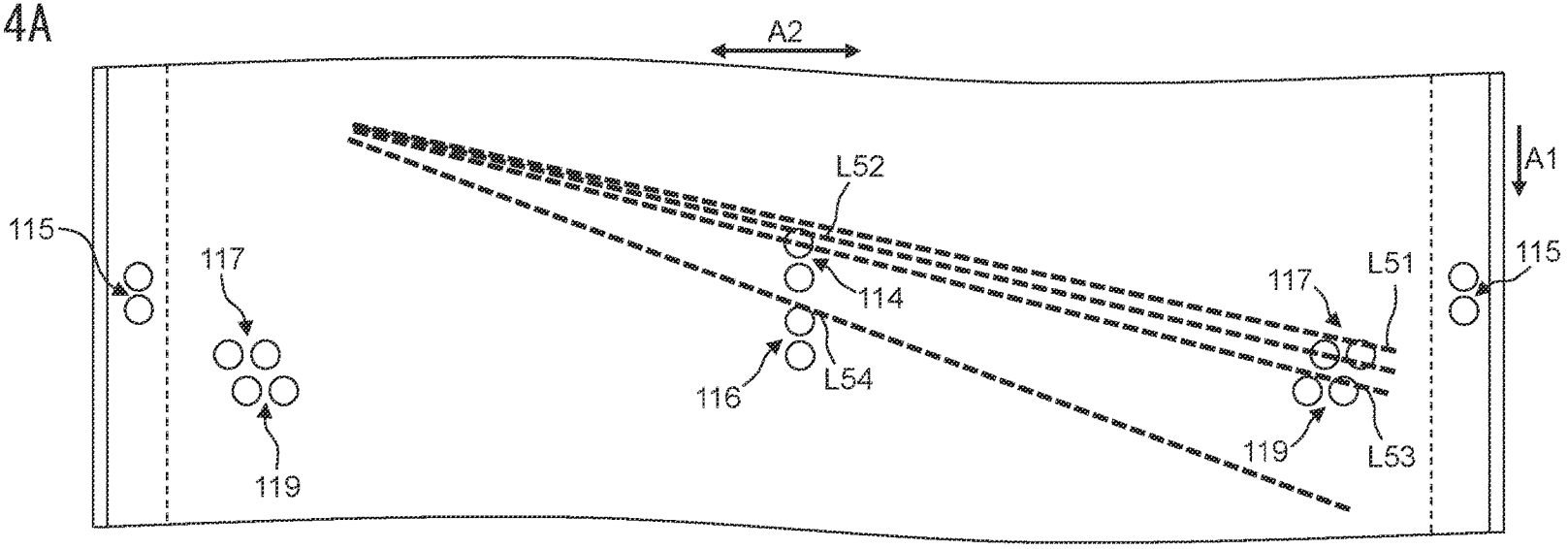
FIG. 14A is a schematic view for explaining cumulative skew.
Figure 14B:
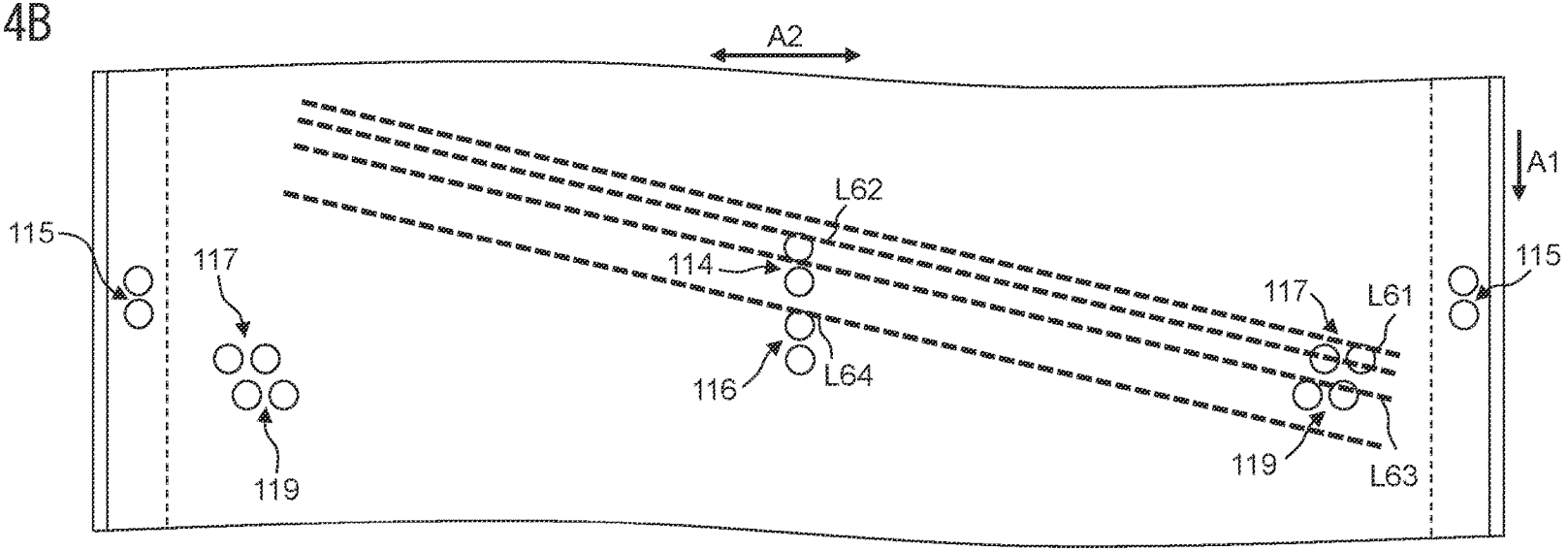
FIG. 14B is a schematic view for explaining abnormal skew.

FIG. 14A is a schematic view for explaining cumulative skew satisfying the cumulative skew condition 8, while FIG. 14B is a schematic view for explaining abnormal skew satisfying the abnormal skew condition 1. FIGS. 14A and 14B are schematic views seen from above of the lower housing 101 in the state with the upper housing 102 opened.

In FIG. 14A, the lines L51 to L54 indicate movement of the front end of the medium where cumulative skew occurs. The line L51 indicates the front end of the medium when passing through one of the plurality of the first side sensors 117. The line L52 indicates the front end of the medium when passing through the first center sensor 114. The line L53 indicates the front end of the medium when passing through a sensor of the plurality of the second side sensors 119 located at the same side as the first side sensor 117 which the medium passes through. The line L54 indicates the front end of the medium when passing through the second center sensor 116.

On the other hand, in FIG. 14B, the lines L61 to L64 respectively indicate movement of the front end of the medium where abnormal skew occurs. The line L61 indicates the front end of the medium when passing through one of the plurality of the first side sensors 117. The line L62 indicates the front end of the medium when passing through the first center sensor 114. The line L63 indicates the front end of the medium when passing through a sensor of the plurality of the second side sensors 119 located at the same side as the first side sensor 117 which the medium passes through. The line L64 indicates the front end of the medium when passing through the second center sensor 116.

In this way, there is a possibility of the order of the sensors detecting the medium being the same in the case where cumulative skew occurs and the case where abnormal skew occurs. However, as explained above, the speed by which the medium advances in the medium conveyance direction A1 when abnormal skew occurs is higher than the speed by which the medium advances in the medium conveyance direction when cumulative skew occurs. Therefore, the medium conveyance apparatus 100 can suitably determine whether cumulative skew has occurred or abnormal skew has occurred based on the interval of the times when the sensors detect the medium.

In the cumulative skew condition 8, it is stated that the front end of the medium moves in the order of the lines L51, L52, L53, and L54 and the time from when the front end of the medium passes through the position of the first side sensor 117 like the line L51 to when the front end of the medium passes through the position of the second center sensor 116 like the line L54 is large. In the abnormal skew condition 1, it is stated that the front end of the medium moves in the order of the lines L61, L62, L63, and L64 and the time from when the front end of the medium passes through the position of the first side sensor 117 like the line L61 to when the front end of the medium passes through the position of the second center sensor 116 like the line L64 is small.

Returning to FIGS. 13A and 13B, as the order condition of the cumulative skew condition 9, it is set that one of the plurality of the first side sensors 117 detects the medium first, one sensor of the plurality of the second side sensors 119 located at the same side as the first side sensor 117 which detected the medium detects the medium second, the first center sensor 114 detects the medium third, and the second center sensor 116 detects the medium fourth. As the time condition of the cumulative skew condition 9, it is set that a ninth time (time period) from when the number one first side sensor 117 detects the medium to when the number four second center sensor 116 detects the medium is larger than a ninth threshold value T9. The ninth threshold value T9 is set in advance to a time between the ninth time when cumulative skew has occurred and the ninth time when abnormal skew has occurred when the medium has conveyed to satisfy the order condition of the cumulative skew condition 9.

On the other hand, as the order condition of the abnormal skew condition 2, a condition the same as the order condition of the cumulative skew condition 9 is set. However, as the time condition of the abnormal skew condition 2, it is set that the ninth time from when the number one first side sensor 117 detects the medium to which the number four second center sensor 116 detects the medium is the ninth threshold value T9 or less.

Figure 15A:
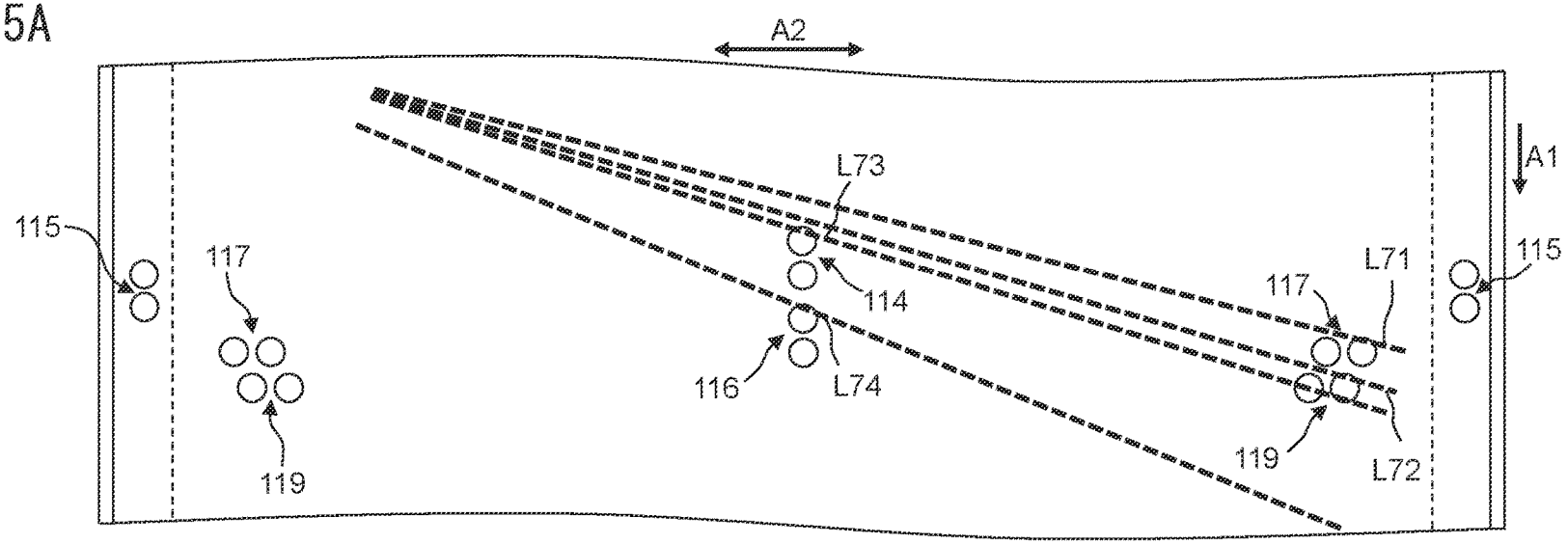
FIG. 15A is a schematic view for explaining cumulative skew.
Figure 15B:
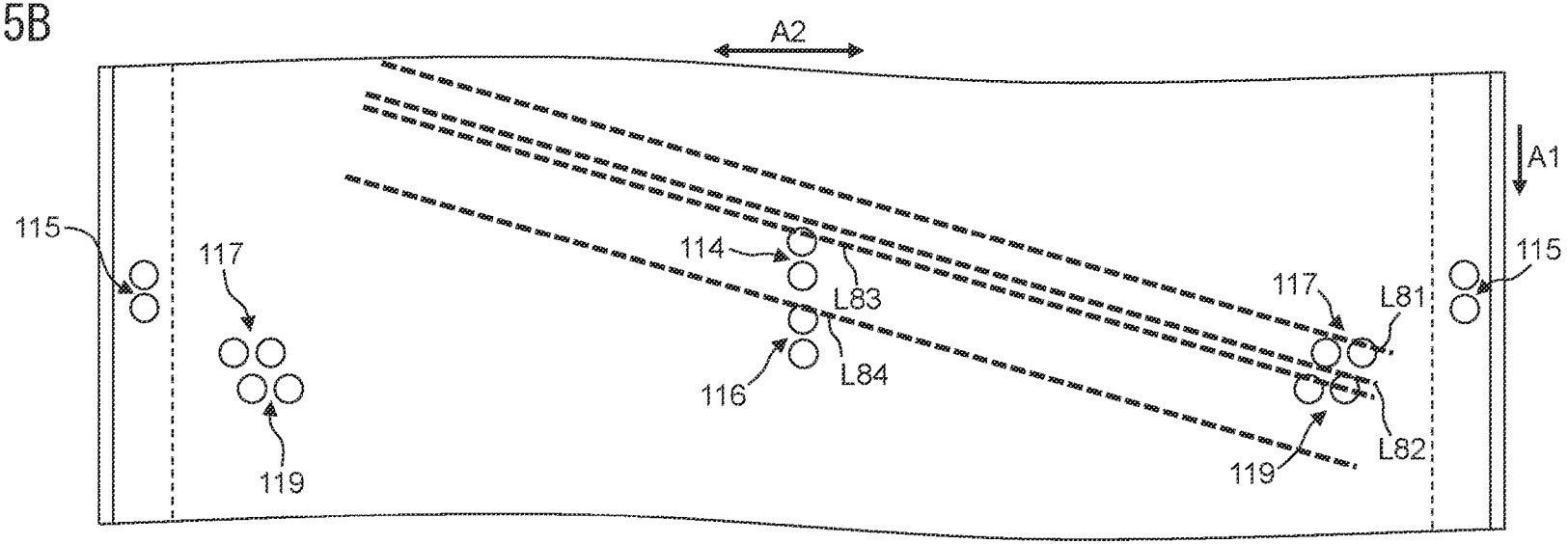
FIG. 15B is a schematic view for explaining abnormal skew.

FIG. 15A is a schematic view for explaining cumulative skew satisfying the cumulative skew condition 9, while FIG. 15B is a schematic view for explaining abnormal skew satisfying the abnormal skew condition 2. FIGS. 15A and 15B are schematic views seen from above of the lower housing 101 in the state with the upper housing 102 opened.

In FIG. 15A, the lines L71 to L74 respectively indicate movement of the front end of the medium where cumulative skew occurs. The line L71 indicates the front end of the medium when passing through one of the plurality of the first side sensors 117. The line L72 indicates the front end of the medium when passing through a sensor of the plurality of the second side sensors 119 located at the same side as the first side sensor 117 which the medium passed through. The line L73 indicates the front end of the medium when passing through the first center sensor 114. The line L74 indicates the front end of the medium when passing through the second center sensor 116.

On the other hand, in FIG. 15B, the lines L81 to L84 respectively indicate movement of the front end of the medium where abnormal skew occurs. The line L81 indicates the front end of the medium when passing through one of the plurality of the first side sensors 117. The line L82 indicates the front end of the medium when passing through a sensor of the plurality of the second side sensors 119 located at the same side as the first side sensor 117 which the medium passes through. The line L83 indicates the front end of the medium when passing through the first center sensor 114. The line L84 indicates the front end of the medium when passing through the second center sensor 116.

In this way, there is a possibility of the order of the sensors detecting the medium being the same in the case where cumulative skew has occurred and the case where abnormal skew has occurred. However, as explained above, the speed by which the medium advances in the medium conveyance direction A1 when abnormal skew occurs is higher than the speed by which the medium advances in the medium conveyance direction when cumulative skew occurs. Therefore, the medium conveyance apparatus 100 can suitably determine whether cumulative skew has occurred or abnormal skew has occurred based on the interval of the times when the sensors detect the medium.

In the cumulative skew condition 9, it is stated that the front end of the medium moves in the order of the lines L71, L72, L73, and L74 and the time from when the front end of the medium passes through the position of the first side sensor 117 like the line L71 to when the front end of the medium passes through the position of the second center sensor 116 like the line L74 is large. In the abnormal skew condition 1, it is stated that the front end of the medium moves in the order of the lines L81, L82, L83, and L84 and the time from when the front end of the medium passes through the position of the first side sensor 117 like the line L81 to when the front end of the medium passes through the position of the second center sensor 116 like the line L84 is small.

As explained in detail above, the medium conveyance apparatus can suitably determine whether the tilt angle of the medium being conveyed has changed even when determining whether cumulative skew has occurred and when abnormal skew has occurred based on the interval of the times when the sensors detect the medium.

FIGS. 16A and 16B are views providing examples of the data structures of the cumulative skew condition table and the abnormal skew condition table in the medium conveyance apparatus according to still another embodiment.

The medium conveyance apparatus according to the present embodiment has a configuration and functions similar to the medium conveyance apparatus 100. However, In the present embodiment, the medium conveyance apparatus does not have the second center sensor 116. The only sensor located at the center part of the medium conveyance path in the width direction A2 is the first center sensor 114. In the present embodiment, the first center sensor 114 is one example of the first sensor and center sensor located at the center part of the medium conveyance path in the direction perpendicular to the medium conveyance direction. Further, the first side sensors 117 are examples of the second sensor and the fourth sensor respectively located at the downstream side from the first sensor in the medium conveyance direction and at one side and the opposite side of the medium conveyance path in the direction perpendicular to the medium conveyance direction. Further, the second side sensors 119 are examples of the third sensor located at the downstream side from the second sensors in the medium conveyance direction and at one side of the medium conveyance path in the direction perpendicular to the medium conveyance direction. Further, the first side sensors 117 and the second side sensors 119 are examples of the side sensor.

In the cumulative skew condition table, cumulative skew conditions for determining whether cumulative skew has occurred using the first center sensor 114, first side sensors 117, and the second side sensors 119 are stored. Further, in the abnormal skew condition table, abnormal skew conditions for determining whether abnormal skew has occurred using the first center sensor 114, first side sensors 117, and the second side sensors 119 are stored.

As the order condition of the cumulative skew condition 1, it is set that the first center sensor 114 detects the medium first, one of the plurality of the first side sensors 117 detects the medium second, and a sensor of the plurality of the second side sensors 119 located at the same side as the first side sensor 117 which detected the medium detects the medium third. In other words, as the order condition of the cumulative skew condition 1, the condition where the second center sensor 116 detecting the medium third is deleted from the cumulative skew condition 2 provided in FIG. 5 is set. As the time condition of the cumulative skew condition 1, it is set that a 10th time (time period) from when the number one first center sensor 114 detects the medium to when the number three second side sensor 119 detects the medium is larger than a 10th threshold value T10. The 10th threshold value T10 is set in advance to a time between the 10th time when cumulative skew has occurred and the 10th time when cumulative skew has not occurred when the medium has been conveyed to satisfy the order condition of the cumulative skew condition 1.

As the order condition of the cumulative skew condition 2, in addition to the order condition of the cumulative skew condition 1, it is set that another sensor, i.e., a sensor of the plurality of the first side sensors 117 located at the opposite side of the first side sensor 117 which already detected the medium detects the medium fourth. In other words, as the order condition of the cumulative skew condition 1, the condition where the second center sensor 116 detecting the medium third is deleted from the cumulative skew condition 3 provided in FIG. 5 is set. As the time condition of the cumulative skew condition 2, it is set that an 11th time (time period) from when the number one first center sensor 114 detecting the medium to when the number four first side sensor 117 detects the medium is larger than an 11th threshold value T11. The 11th threshold value T11 is set in advance to a time between the 11th time when cumulative skew has occurred and the 11th time when cumulative skew has not occurred when the medium has been conveyed to satisfy the order condition of the cumulative skew condition 2.

As the order condition of the cumulative skew condition 3, it is set that one of the plurality of the first side sensors 117 detects the medium first, the first center sensor 114 detects the medium second, and a sensor of the plurality of the second side sensors 119 located at the same side as the first side sensor 117 which detected the medium detects the medium third. In other words, as the order condition of the cumulative skew condition 3, the condition where the first center sensor 114 detecting the medium first is deleted from the cumulative skew condition 2 provided in FIG. 5 and the first center sensor 114 detects the medium third instead of the second center sensor 116 is set. As the time condition of the cumulative skew condition 3, it is set that a 12th time (time period) from when number one first side sensor 117 detects the medium to when the number three second side sensor 119 detects the medium is larger than a 12th threshold value T12. The 12th threshold value T12 is set in advance to a time between the 12th time when cumulative skew has occurred and the 12th time when cumulative skew has not occurred when the medium has been conveyed to satisfy the order condition of the cumulative skew condition 3.

As the order condition of the cumulative skew condition 4, in addition to the order condition of the cumulative skew condition 3, it is set that another sensor of the plurality of the first side sensors 117, i.e., a sensor located at the opposite side of the first side sensor 117 which already detected the medium detects the medium fourth. In other words, as the order condition of the cumulative skew condition 4, the condition where the first center sensor 114 detecting the medium first is deleted from the cumulative skew condition 3 provided in FIG. 5 and the first center sensor 114 detects the medium third instead of the second center sensor 116 is set. As the time condition of the cumulative skew condition 4, it is set that a 13th time (time period) from when number one first side sensor 117 detects the medium to when the number four first side sensor 117 detects the medium is larger than the 13th threshold value T13. The 13th threshold value T13 is set in advance to a time between the 13th time when cumulative skew has occurred and the 13th time when cumulative skew has not occurred when the medium has been conveyed to satisfy the order condition of the cumulative skew condition 4.

On the other hand, as the abnormal skew condition 1, a condition the same as the abnormal skew condition 1 provided in FIG. 7 may be set and as the abnormal skew condition 2, a condition the same as the abnormal skew condition 3 provided in FIG. 7 may be further set.

In the present embodiment as well, the determination module 152 determines whether a cumulative skew condition has been satisfied to thereby determine whether cumulative skew of the medium has occurred. In other words, the determination module 152 determines whether the tilt angle of the medium being conveyed has changed based on which one of sensors detected the medium first, second, and third. Furthermore, the determination module 152 determines whether the tilt angle of the medium being conveyed has changed based on the total of the intervals of the times when the sensors detect the medium, i.e., at least the time from when the sensor detected the medium first detected the medium to when the sensor detected the medium third detected the medium.

In particular, the determination module 152 determines whether the cumulative skew condition 1 has been satisfied to thereby determine whether cumulative skew of the medium has occurred. In other words, the determination module 152 determines whether the tilt angle of the medium being conveyed has changed based on the 10th time from when the first center sensor 114 detects the medium to when the second side sensor 119 detects the medium when the first center sensor 114 detects the medium first, one of the plurality of the first side sensors 117 detects the medium second, and a sensor of the plurality of the second side sensors 119 located at the same side as the first side sensor 117 detecting the medium second detects the medium third.

Further, the determination module 152 determines whether the cumulative skew condition 3 has been satisfied to thereby determine whether cumulative skew of the medium has occurred. In other words, the determination module 152 determines whether the tilt angle of the medium being conveyed has changed based on the 12th time from when the first center sensor 114 detects the medium to when the second side sensor 119 detects the medium when one of the plurality of the first side sensors 117 detects the medium first, the first center sensor 114 detects the medium second, and a sensor of the plurality of the second side sensors 119 located at the same side as the first side sensor 17 detecting the medium first detects the medium third.

Further, the determination module 152 determines whether the cumulative skew condition 2 has been satisfied to thereby determine whether cumulative skew of the medium has occurred. In other words, the determination module 152 determines whether the tilt angle of the medium being conveyed has changed based on the 11th time from when the first center sensor 114 detects the medium to when another sensor of the plurality of the first side sensors 117 detects the medium when the first center sensor 114 detects the medium first, one of the plurality of the first side sensors 117 detects the medium second, and a sensor of the plurality of the second side sensors 119 located at the same side as the first side sensor 117 detecting the medium second detects the medium third, then another sensor of the plurality of the first side sensors 117 detects the medium.

Further, the determination module 152 determines whether the cumulative skew condition 4 has been satisfied to thereby determine whether cumulative skew of the medium has occurred. In other words, the determination module 152 determines whether the tilt angle of the medium being conveyed has changed based on the 12th time from when one of the plurality of the first side sensors 117 detects the medium to when another sensor detects the medium when one of the plurality of the first side sensors 117 detects the medium first, the first center sensor 114 detects the medium second, a sensor of the plurality of the second side sensors 119 located at the same side as the first side sensor 117 detecting the medium first detects the medium third, then another sensor of the plurality of the first side sensors 117 detects the medium.

Due to these, the determination module 152 can determine that the tilt angle of the medium being conveyed has changed early and with a high precision.

Further, the determination module 152 determines whether the abnormal skew condition 1 or the abnormal skew condition 2 has been satisfied to thereby determine whether abnormal skew of the medium has occurred. In other words, the determination module 152 determines that skew has occurred where the tilt angle of the medium being conveyed does not change when one of the plurality of the second side sensors 119 detects the medium before the first center sensor 114 detects the medium.

The determination module 152 can determine that the medium being conveyed has been conveyed to strike a side wall of the conveyance path early and with a high precision.

As explained above in detail, the medium conveyance apparatus can suitably determine whether the tilt angle of the medium being conveyed has changed even when there is just one sensor located at the center part of the medium conveyance path.

FIGS. 17A and 17B are views respectively presenting examples of the data structures of the cumulative skew condition table and the abnormal skew condition table in the medium conveyance apparatus according to still another embodiment.

The medium conveyance apparatus according to the present embodiment has the same configuration and functions as the medium conveyance apparatus 100. However, in the present embodiment, the medium conveyance apparatus does not have the second center sensor 116. The only sensor located at the center part of the medium conveyance path in the width direction A2 is the first center sensor 114. In the cumulative skew condition table, in addition to the cumulative skew conditions 1 to 4 provided in FIG. 16A, the cumulative skew condition 5 provided in FIG. 17A is set. Further, in the abnormal skew condition table, the abnormal skew condition 1 provided in FIG. 17B is set instead of the abnormal skew conditions 1 to 2 provided in FIG. 16B.

As the order condition of the cumulative skew condition 5, it is set that one of the plurality of the first side sensors 117 detects the medium first, a sensor of the plurality of the second side sensors 119 located at the same side as the first side sensor 117 which detected the medium detects the medium second, and the first center sensor 114 detects the medium third. In other words, as the order condition of the cumulative skew condition 1, the condition where the second center sensor 116 detecting the medium fourth is deleted from the cumulative skew condition 9 provided in FIG. 13A is set. As the time condition of the cumulative skew condition 5, it is set that a 14th time (time period) from when the number one first side sensor 117 detects the medium to when the number three first center sensor 114 detects the medium is larger than a 14th threshold value T14. The 14th threshold value T14 is set in advance to a time between the 14th time when cumulative skew has occurred and the 14th time when abnormal skew has occurred when the medium has been conveyed to satisfy the order condition of the cumulative skew condition 5.

On the other hand, as the order condition of the abnormal skew condition 1, a condition the same as the order condition of the cumulative skew condition 5 is set. In other words, as the order condition of the abnormal skew condition 1, the condition where the second center sensor 116 detecting the medium fourth is deleted from the abnormal skew condition 2 provided in FIG. 13B is set. However, as the time condition of the abnormal skew condition 1, it is set that the 14th time from when the number one first side sensor 117 detects the medium to when the number three first center sensor 114 detects the medium is the 14th threshold value T14 or less.

As explained in detail above, in the medium conveyance apparatus, there is a single sensor located at the center part of the medium conveyance path. The medium conveyance apparatus determines whether cumulative skew has occurred or abnormal skew has occurred based on the time between when the sensors detect the medium. In this case as well, the medium conveyance apparatus can suitably determine whether the tilt angle of the medium being conveyed has changed.

Figure 18:
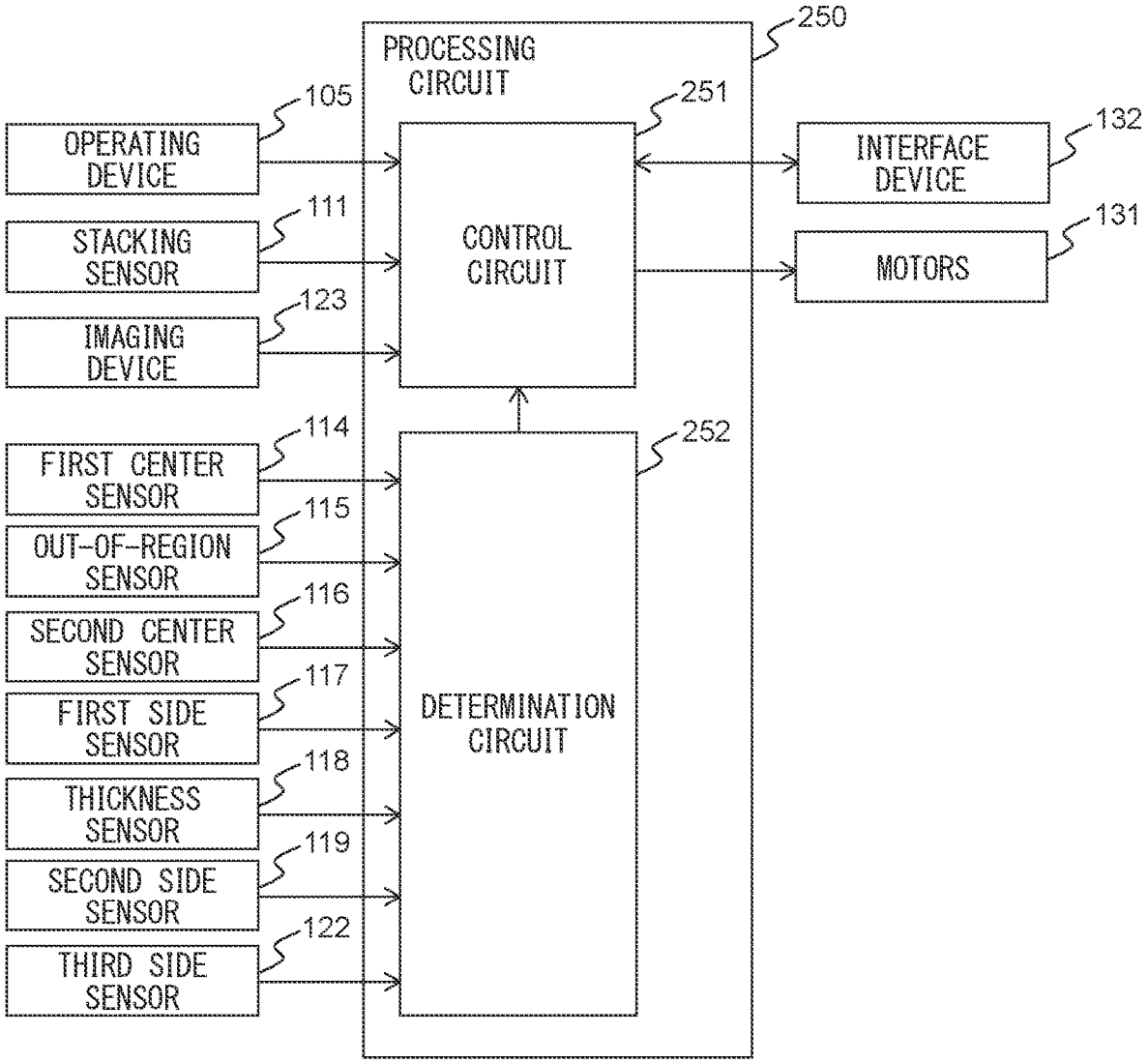
FIG. 18 is a view presenting a schematic configuration of a processing circuit according to another embodiment.

FIG. 18 is a view presenting the schematic configuration of a processing circuit in a medium conveyance apparatus in another embodiment. The processing circuit 250 is used instead of the processing circuit 150 of the medium conveyance apparatus 100 and performs medium reading processing, etc., instead of the processing circuit 150. The processing circuit 250 has the control circuit 251, the determination circuit 252, etc.

The control circuit 251 is one example of the control part and has functions similar to the control module 151. The control circuit 251 receives the operating signal from the operating device 105 or interface device 132, the stacking signal from the stacking sensor 111, and the determination results of cumulative skew or abnormal skew from the determination circuit 252. The control circuit 251 controls the motors 131 based on the received signals and acquires the input image from the imaging device 123 and outputs it to the interface device 132.

The determination circuit 252 is one example of the determination module and has functions similar to the determination module 152. The determination circuit 252 respectively receives the first center signal from the first center sensor 114, the out-of-region signals from the out-of-region sensors 115, the second center signal from the second center sensor 116, the first side signals from the first side sensors 117, the thickness signal from the thickness sensor 118, the second side signals from the second side sensors 119, and the third side signals from the third side sensors 122. The determination circuit 252 determines whether cumulative skew and abnormal skew of the medium have occurred based on the received signals and outputs the result of determination to the control circuit 251.

As explained in detail above, the medium conveyance apparatus can suitably determine whether the tilt angle of the medium being conveyed has changed even when using the processing circuit 250.

Above, preferred embodiments were explained, but the embodiments are not limited to these. For example, the medium conveyance apparatus may correct the skew of the medium by making the peripheral speeds of the pluralities of the first conveyance rollers 120, the second conveyance rollers 121, the third conveyance rollers 124, and/or the fourth conveyance rollers 125 different from each other instead of the plurality of the feed rollers 112.

Further, in the medium conveyance apparatus, any sensors of the plurality of the out-of-region sensors 115, the plurality of the first side sensors 117, the plurality of the second side sensors 119, and/or the plurality of the third side sensors 122 may be omitted.

Further, the medium conveyance apparatus may change the determination criteria of whether to perform correction of skew and/or determination criteria of whether to perform abnormality processing in the case of operating in the separation mode and in the case of operating in the nonseparation mode. For example, the control module 151 performs correction of skew of the medium when cumulative skew of the medium has occurred in the case of operating in the separation mode and does not perform correction of skew of the medium even when cumulative skew of the medium has occurred in the case of operating in the nonseparation mode. The medium conveyance apparatus can suppress occurrence of jamming of the medium. Further, the control module 151 performs correction of skew of the medium when cumulative skew of the medium has occurred in the case of operating in the separation mode and performs abnormality processing when cumulative skew of the medium has occurred in the case of operating in the nonseparation mode. The medium conveyance apparatus can prevent jamming of the medium from occurring. Further, the control module 151 can make the skew threshold value in the case of operating in the nonseparation mode smaller than the skew threshold value in the case of operating in the separation mode. The medium conveyance apparatus can suppress occurrence of jamming of the medium.

Further, the medium conveyance apparatus may change the determination criteria of abnormal skew between the case of operating in the separation mode and the case of operating in the nonseparation mode. For example, the determination module 152 makes the determination criteria in the case of operating in the nonseparation mode stricter than determination criteria of abnormal skew in the separation mode. The determination module 152 makes the first to the 14th threshold values T1 to T14 in the case of operating in the nonseparation mode larger than the first to the 14th threshold values T1 to T14 in the case of operating in the separation mode to thereby make the determination criteria stricter. The medium conveyance apparatus can suppress that the medium is forcibly over corrected and the medium is damaged.

Further, the medium conveyance apparatus may have a so-called U-turn path and feed and convey the medium stacked on the stacking tray from the upper side to eject it to the ejection tray. In this case, the feed roller is located above the separation roller facing the separation roller. In this case as well, the medium conveyance apparatus can suitably determine whether the tilt angle of the medium being conveyed has changed.

The medium conveyance apparatus is desired to suitably determine whether a tilt angle of the medium being conveyed has changed in order to suppress the medium as a whole not being captured or jamming of the medium (paper jam) occurring by the medium striking the side wall of the conveyance path.

According to the embodiment, the medium conveyance apparatus, control method, and control program can suitably determine whether the tilt angle of the medium being conveyed has changed.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a presentation of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveyance apparatus comprising:

a conveyance roller to convey a medium;

a first sensor located at a center part of a medium conveyance path in a direction perpendicular to a medium conveyance direction;

a second sensor located at a downstream side from the first sensor in the medium conveyance direction and at the center part of the medium conveyance path in the direction perpendicular to the medium conveyance direction;

a third sensor located at a downstream side from the second sensor in the medium conveyance direction and at the one side of the medium conveyance path in the direction perpendicular to the medium conveyance direction; and a processor to determine whether a tilt angle of the medium being conveyed has changed based on a time from when the first sensor detects the medium to when the second sensor detects the medium when the first sensor detects the medium first, the third sensor detects the medium second, and the second sensor detects the medium third.

2. The medium conveyance apparatus according to claim 1, further comprising a fourth sensor located at a downstream side from the second sensor in the medium conveyance direction and at the opposite side of the one side of the medium conveyance path in the direction perpendicular to the medium conveyance direction, wherein the processor determines whether the tilt angle of the medium being conveyed has changed based on a time from when the first sensor detects the medium to when the fourth sensor detects the medium.

3. The medium conveyance apparatus according to claim 1, further comprising a fifth sensor located at a downstream side from the third sensor in the medium conveyance direction and at the one side of the medium conveyance path in the direction perpendicular to the medium conveyance direction, wherein the processor determines whether the tilt angle of the medium being conveyed has changed based on a time from when the first sensor detects the medium to when the fifth sensor detects the medium when the first sensor detects the medium first, the third sensor detects the medium second, and the fifth sensor detects the medium third.

4. The medium conveyance apparatus according to claim 1, wherein the processor determines that skew has occurred where the tilt angle of the medium being conveyed does not change when the third sensor detects the medium before the first sensor detects the medium.

5. The medium conveyance apparatus according to claim 1, further comprising a fifth sensor located at a downstream side from the third sensor in the medium conveyance direction and at the one side of the medium conveyance path in the direction perpendicular to the medium conveyance direction, wherein the processor determines that skew has occurred where the tilt angle of the medium being conveyed does not change when the fifth sensor detects the medium before the first sensor detects the medium.

6. A medium conveyance apparatus comprising:

a conveyance roller to convey a medium;

a first sensor located at a center part of a medium conveyance path in a direction perpendicular to a medium conveyance direction;

a second sensor located at a downstream side from the first sensor in the medium conveyance direction and the one side of the medium conveyance path in the direction perpendicular to the medium conveyance direction;

a third sensor located at a downstream side from the second sensor in the medium conveyance direction at the one side of the medium conveyance path in the direction perpendicular to the medium conveyance direction; and a processor to determine whether a tilt angle of the medium being conveyed has changed based on a time from when one of the first sensor and the second sensor detects the medium to when the third sensor detects the medium when the one of the first sensor and the second sensor detects the medium first, the other of the first sensor and the second sensor detects the medium second, and the third sensor detects the medium third.

7. The medium conveyance apparatus according to claim 6, further comprising a fourth sensor located at a downstream side from the first sensor in the medium conveyance direction and at the opposite side of the one side of the medium conveyance path in the direction perpendicular to the medium conveyance direction, wherein the processor determines whether the tilt angle of the medium being conveyed has changed based on a time from when the one of the first sensor and the second sensor detects the medium to when the fourth sensor detects the medium.

8. The medium conveyance apparatus according to claim 6, wherein the processor determines that skew has occurred where the tilt angle of the medium being conveyed does not change when the third sensor detects the medium before the first sensor detects the medium.

9. A medium conveyance apparatus comprising:

a conveyance roller to convey a medium;

a center sensor located at a center part of a medium conveyance path in a direction perpendicular to a medium conveyance direction;

a side sensor located at a downstream side from the center sensor in the medium conveyance direction and one side of the medium conveyance path in a direction perpendicular to the medium conveyance direction; and a processor to determine whether a tilt angle of the medium being conveyed has changed, wherein at least one of the center sensor and the side sensor includes two sensors located at positions different from each other in the medium conveyance direction, wherein the processor determines whether the tilt angle of the medium being conveyed has changed based on which one of sensors detected the medium first, second, and third, and a time from when the sensor detected the medium first detected the medium to when the sensor detected the medium third detected the medium.

* * * * *